US006554255B2

(12) United States Patent
Fujikawa

(10) Patent No.: US 6,554,255 B2
(45) Date of Patent: Apr. 29, 2003

(54) LIFTING GEAR

(75) Inventor: Masaru Fujikawa, Osakasayama (JP)

(73) Assignee: Elephant Chain Block Co., Ltd., Osakasayama (JP)

( * ) Notice: Subject to any disclaimer, the term of this patent is extended or adjusted under 35 U.S.C. 154(b) by 0 days.

(21) Appl. No.: 10/136,492

(22) Filed: May 2, 2002

(65) Prior Publication Data

US 2002/0121633 A1 Sep. 5, 2002

Related U.S. Application Data

(63) Continuation of application No. 09/442,483, filed on Nov. 18, 1999.

(30) Foreign Application Priority Data

Nov. 19, 1998 (JP) ..... 10-330031
Oct. 18, 1999 (JP) ..... 11-296021

(51) Int. Cl.[7] ..... B66D 1/20; B66D 3/16
(52) U.S. Cl. ..... 254/358; 254/372; 254/342
(58) Field of Search ..... 254/339, 340, 254/342, 344, 358, 362, 372

(56) References Cited

U.S. PATENT DOCUMENTS

| | | | |
|---|---|---|---|
| 2,374,450 | A | 4/1945 | Nelles |
| 2,403,462 | A | 7/1946 | Schroeder |
| 2,435,353 | A | 2/1948 | Hite |
| 3,894,720 | A | 7/1975 | Koji |
| 5,374,035 | A | 12/1994 | Santos |
| 5,603,489 | A | 2/1997 | Regal |
| 5,678,452 | A | 10/1997 | Frazier |
| 5,738,340 | A | 4/1998 | Brantner |
| 5,871,069 | A | 2/1999 | Carmitchel |
| 6,105,938 | A | 8/2000 | Koida |

FOREIGN PATENT DOCUMENTS

| | | |
|---|---|---|
| EP | 0 878 436 A2 | 11/1998 |
| JP | 0034258 | 3/1978 |
| JP | 54-102747 | 8/1979 |
| JP | 58-202295 | 11/1983 |
| JP | 61-236951 | 10/1986 |
| JP | 10-338476 | 12/1998 |
| TW | 79200347 | 1/1990 |
| TW | 84111110 | 10/1995 |

*Primary Examiner*—Emmanuel Marcelo
(74) *Attorney, Agent, or Firm*—Burns, Doane, Swecker & Mathis, LLP

(57) ABSTRACT

A lifting gear, which is provided with a load-sheave that shifts a sinuate body in the longitudinal direction thereof and a rotary body that rotates the load-sheave, and in which the rotary body include a power connecting section that can be coupled to an electric driver, wherein the load-sheave is driven by the electric driver that is not incorporated in the lifting gear.

18 Claims, 30 Drawing Sheets

LIFTING GEAR

This application is a continuation of application Ser. No. 09/442,483, filed on Nov. 18, 1999.

BACKGROUND OF THE INVENTION

The present invention relates to a lifting gear which is arranged so that its load-sheave can be driven by a portable mechanical-driving equipment such as an electric driver or a portable manual-driving equipment such as a handle manually rotated.

Generally-used lifting gears are classified into those of a manual type having a chain that is manually moved or a lever that is manually rotated and those of electric type having an electric motor.

These lifting gears of the manual type and the electric type have almost the same construction except whether the driving means for driving the load-sheave is a chain or a lever, or an electric motor.

FIG. 1 shows a cross-sectional view showing a conventional lifting gear of the manual type. This lifting gear is provided with: a load-sheave 100 for shifting a sinuate body such as a load chain in the longitudinal direction; a rotatable shaft body at transmission side 101 that penetrates the load-sheave 100; a ring body (a hand chain wheel) 102 that is threadedly engaged to one end of the shaft body 101 so as to rotate forwardly or reversely in an interlocked manner with the shifting operation of a chain (driving means); a braking mechanism (mechanical brake) 103 that transmits the forward rotation of the ring body 102 to the shaft body 101, and also applies a braking force to the reverse rotation of the shaft body 101 thereof; a cover body 104 for covering the ring body 102; a reduction gear mechanism 105 installed between the other end of the shaft body 101 and the load-sheave 100; a pair of side plates 106 supporting the load-sheave 100; and a gear cover 107 that is attached to one of the side plates 106. Thus, the chain, passed and latched around the circumferential portion of the ring body 102, is operated and shifted so as to forwardly or reversely rotate the ring body 102 so that the load-sheave 100 is driven by a torque transmitted through the braking mechanism 103 and through the shaft body at transmission side 101 and the reduction gear mechanism 105.

Moreover, those of the electric type have an arrangement in which: although not shown in the Figure, the ring body 102, the braking mechanism 103 and the cover body 104 are omitted therefrom, and a motor housing containing an electric motor is connected to one of the side plates, and the driving shaft of the electric motor is coupled to one end of the shaft body at transmission side so that the load-sheave is forwardly or reversely driven by the electric motor through the shaft body at transmission side and the reduction gear mechanism.

Here, as compared with that of the electric type, the lifting gear of the manual type, which uses a chain or a lever as the driving means, is compact and light-weight, and easily applicable to cases other than those hanged from the ceiling, and it is constructed at low costs; in contrast, since the load-sheave has to be manually operated, greater labor is required.

On the contrary, the lifting gear of the electric type using an electric motor as the driving means requires smaller labor as compared with those of the manual type; however, it is bulky and heavy as compared with those of the manual type, the application is limited to those cases hanged from the ceiling, and it also requires high costs.

BRIEF SUMMARY OF THE INVENTION

One of the objectives of the present invention is to provide a lifting gear which can use a portable mechanical-driving equipment, such as an electric driver commercially available as an electric tool, as a driving means for the load-sheave without the need for incorporating it in the lifting gear, by providing a power connecting portion for coupling the portable driving equipment to the rotary body for rotating the load-sheave.

Another objective of the present invention is to provide a lifting gear in which, in the case of the portable mechanical-driving equipment of a charging type, even if the battery runs short, the load-sheave can be driven by providing a handle detachably attached to the power connecting portion or a chain latch portion on which an operative chain is latched.

Still another objective of the present invention is to provide a lifting gear in which the rotary body is divided into a shaft body at input side that is inserted into a hole that allows the power connecting portion to expose to the outside of the frame and an interlock body that is interlocked with the load-sheave so that the portable driving equipment is easily coupled to the power connecting portion.

Still another objective of the present invention is to provide a lifting gear in which: it is possible to prevent the shaft body from sticking out of the frame, and also to prevent damages to the power connecting portion, by allowing the shaft body to be drawn from the hole when not used, and when used, coupling to the portable driving equipment is available by inserting the shaft body into the hole of the frame.

Still another objective of the present invention is to provide a lifting gear in which: it is possible to prevent damages to the shaft body at input side due to bending load and also to reduce power loss of the portable driving equipment, by providing the hole as a fitting hole to which the shaft body is fitted or attaching a bearing sleeve to the hole.

Still another objective of the present invention is to provide a lifting gear in which the load-sheave can be driven by a remote operation by providing a flexible-type shaft body.

Still another objective of the present invention is to provide a lifting gear in which, even when a charging-type electric driver commercially available as an electric tool is used as the portable mechanical-driving equipment, the load-sheave can be driven at a speed identical to that of a generally-used manual type which can generate a sufficient torque to lift a predetermined load, by providing a reduction mechanism.

Still another objective of the present invention is to provide a lifting gear in which, even when the shaft body at input side is rotated without a load applied thereon, the load-sheave can be driven without the rotation of the frame, by using a reduction mechanism having a planetary gear.

In the lifting gear in accordance with the first aspect which is a lifting gear having a load-sheave for shifting a sinuate body in the longitudinal direction and a rotary body for rotating the load-sheave in an interlocked manner with the driving means, the rotary body is provided with a power connecting portion that can be coupled to the driving means using a portable driving equipment.

In the first aspect, since the rotary body for rotating the load-sheave is provided with the power connecting portion that can be coupled to the driving means that uses a portable driving equipment, a portable mechanical-driving equipment, such as a charging-type electric driver commercially available as an electric tool, is coupled to the power connecting portion so that the portable mechanical-driving equipment is used as the driving means for the load-sheave; thus it is possible to reduce labor required as compared with that of a manual type. Moreover, since a manually operable construction is provided without the need for incorporating the portable driving equipment into the lifting gear, the lifting gear is compact and light-weight as compared with those of the electric type, and easily applicable to cases other than those hanged from the ceiling, and it is constructed at low costs.

In the lifting gear in accordance with the second aspect that has a modified construction of the first aspect, a frame for covering the load-sheave and the rotary body is provided, and a hole that allows the power connecting portion to expose to the outside is formed in the frame.

In the second aspect, since the hole that allows the power connecting portion to expose to the outside is formed in the frame covering the load-sheave and the rotary body, the frame makes it possible to prevent the rotary body from contacting other things and being damaged, and the portable driving equipment is easily coupled to the power connecting portion.

In the lifting gear in accordance with the third aspect that has a modified construction of the second aspect, the rotary body is provided with the power connecting portion, and divided into the shaft body at input side to be inserted into the hole and the interlock body that is moved in an interlocked manner with the load-sheave.

In the third aspect, since the power connecting portion is placed outside the frame, the portable driving equipment is coupled to the power connecting portion more easily.

In the lifting gear in accordance with the fourth aspect which has a modified construction of the third aspect, the shaft body at input side is allowed to be drawn from the hole.

In the fourth aspect, it is possible to prevent the shaft body at input side having the power connecting portion from protruding outward from the frame, when not used, and consequently to prevent damages to the power connecting portion; moreover, when used, coupling to the portable driving equipment is easily made by inserting the shaft body at input side into the hole of the frame.

In the lifting gear in accordance with the fifth aspect which has a modified construction of the third or the fourth aspect, the hole is provided as a fitting hole to which the shaft body at input side is fitted.

In the fifth aspect, in the case when the portable driving equipment is coupled to the power connecting portion with the power of the portable driving equipment being transmitted to the shaft body at input side, even if a bending load is imposed on the shaft body at input side, the bending load is applied to the fitting hole from the shaft body at input side; therefore, it is possible to properly prevent damages to the shaft body at input side due to the bending load.

In the lifting gear in accordance with the sixth aspect which has a modified construction of the third or the fourth aspect, a bearing sleeve having a fitting hole to which the shaft body is fitted is attached to the hole.

In the sixth aspect, the bending load, imposed on the shaft body at input side, is applied to the bearing sleeve that is a member separated from the frame; therefore, as compared with cases without the bearing sleeve, it is possible to reduce the rotation resistance of the shaft body at input side, and consequently to decrease power losses in the portable driving equipment.

In the lifting gear in accordance with the seventh aspect which has a modified construction of the sixth aspect, the hole is provided as a threaded hole, and the bearing sleeve has a screw that is screwed to the threaded hole.

In the seventh aspect, the shaft body at input side, which is fitted and held in the fitting hole, is easily attached to the frame together with the bearing sleeve, and the shaft body at input side is also removed together with the bearing sleeve by loosening the bearing sleeve.

In the lifting gear in accordance with the eighth aspect which has a modified construction of the third or fourth aspect, the shaft body at input side is provided with, at one end, a link portion which is connected to the interlock body, and the shaft body is also provided with, at the other end, a flexible shaft having the power connecting portion, a flexible tube that rotatably houses the flexible shaft, and a bearing sleeve that is connected to one end of the flexible tube and has a fitting hole to which the flexible shaft is fitted.

In the eighth aspect, in the same manner as that of a generally used manual type using a chain as the driving means, the load-sheave can be driven by a remote control.

The lifting gear in accordance with the ninth aspect, which has a modified construction of the third, fourth or eighth aspect, is provided with a handle that is detachably attached to the power connecting portion.

In the ninth aspect, even in the case when the portable mechanical-driving equipment, such as a charging-type electric driver commercially available as an electric tool, runs short of power in the battery, or when the portable mechanical-driving equipment becomes out of order, the handle can be attached to the power connecting portion instead of the portable mechanical-driving equipment so that the load-sheave is driven by a manual rotating operation; thus, the hoisting work can be continued.

In the lifting gear in accordance with the 10th aspect, which has a modified construction of the third aspect, the interlock body is provided with a shaft body at transmission side facing the shaft body at input side in the shaft length direction, a ring body that is threadedly engaged to the shaft body at transmission side so as to rotate forwardly or reversely, a braking mechanism that transmits the forward rotation of the ring body to the shaft body at transmission side and applies a braking force to the reverse rotation of the shaft body at transmission side; and a reduction mechanism is installed between the ring body and shaft body at input side.

In the 10th aspect, the rotation of the portable mechanical-driving equipment forming the driving means is reduced and transmitted to the ring body; therefore, even when an electric driver of a charging type commercially available as an electric tool is used as the portable mechanical-driving equipment, the load-sheave is driven at a speed identical to that of a generally-used manual type that can generate an enough torque to lift a predetermined load. The electric driver, which generally has a rotation speed that is so fast as compared with the manual-type lifting gear generally used that it fails to exert a sufficient torque to lift a predetermined load; however, the incorporation of the reduction mechanism makes it possible to use such a commercially available electric driver.

In the lifting gear in accordance with the 11th aspect which has a modified construction of the 10th aspect, the reduction mechanism is provided with an input gear to which the rotation force of the shaft body at input side is inputted, a planetary gear that revolves around the input gear so as to transmit its revolution force to the ring body, and a ring-shaped sun gear that supports the planetary gear inside the frame.

In the 11th aspect, the planetary gear transmits its revolution force to the ring body while revolving around the shaft body at input side facing the shaft body at transmission side in the shaft length direction; therefore, even in the case when the shaft body at input side is rotated by the portable mechanical-driving equipment with no load applied thereto, it is possible to prevent a rotation torque from occurring on the frame, and consequently to drive the load-sheave without the rotation of the frame.

In the lifting gear in accordance with the 12th aspect which has a modified construction of the 10th or 11th aspect, the ring body is provided with a chain latch portion on the outer circumference thereof on which an operable chain is latched.

In the 12th aspect, since the chain latch portion is placed on the outer circumferential portion of the ring body, a generally-used manual-type chain is used as the driving means; thus, by using this chain, the load-sheave can be driven in the same manner as the generally-used manual-type lifting gear.

In a lifting gear in accordance with the 13th aspect, at one end of a shaft body at transmission side that rotatably penetrates a load-sheave for shifting a sinuate body in the longitudinal direction are installed a ring body that is threadedly engaged to the shaft body so as to rotate forwardly or reversely in an interlocked manner with a driving means, a braking mechanism that transmits the forward rotation of the ring body to the shaft body and applies a braking force to the reverse rotation of the shaft body, and a cover body for covering the ring body; and between the other end of the shaft body at transmission side and the load-sheave is installed a reduction gear mechanism. In this arrangement, inside the cover body are installed: a power connecting portion that can be coupled to the driving means using a portable driving equipment, a shaft body at input side that faces the shaft body at transmission side in the shaft length direction and a planetary reduction mechanism which has an input gear to which the rotation force of the shaft body at input side is inputted, a planetary gear that revolves around the input gear so as to transmit its revolution force to the ring body and a ring-shaped sun gear that engages the planetary gear.

In the 13th aspect, the construction is achieved by modifying a generally-used manual-type cover body so as to incorporate the planetary reduction mechanism into the cover body; therefore, the load-sheave can be driven in the same manner as an electric-type lifting gear with a slight cost increase as compared with the manual-type lifting gear.

In the lifting gear in accordance with the 14th aspect which has a modified construction of the 13th aspect, a bearing sleeve having a fitting hole to which the shaft body at input side is fitted is attached to the cover body, and a power connecting portion is placed outside the bearing sleeve.

In the 14th aspect, since a bending load, imposed on the shaft body at input side, is applied to the bearing sleeve, the rotation resistance of the shaft body can be reduced as compared with the case without the bearing sleeve, thereby making it possible to reduce power losses.

The above and further objects and features of the invention will more fully be apparent from the following detailed description with accompanying drawings.

DETAILED DESCRIPTION OF THE INVENTION

Referring to Figures, the following description will discuss embodiments of the present invention in detail.

Embodiment 1

Figure 2:
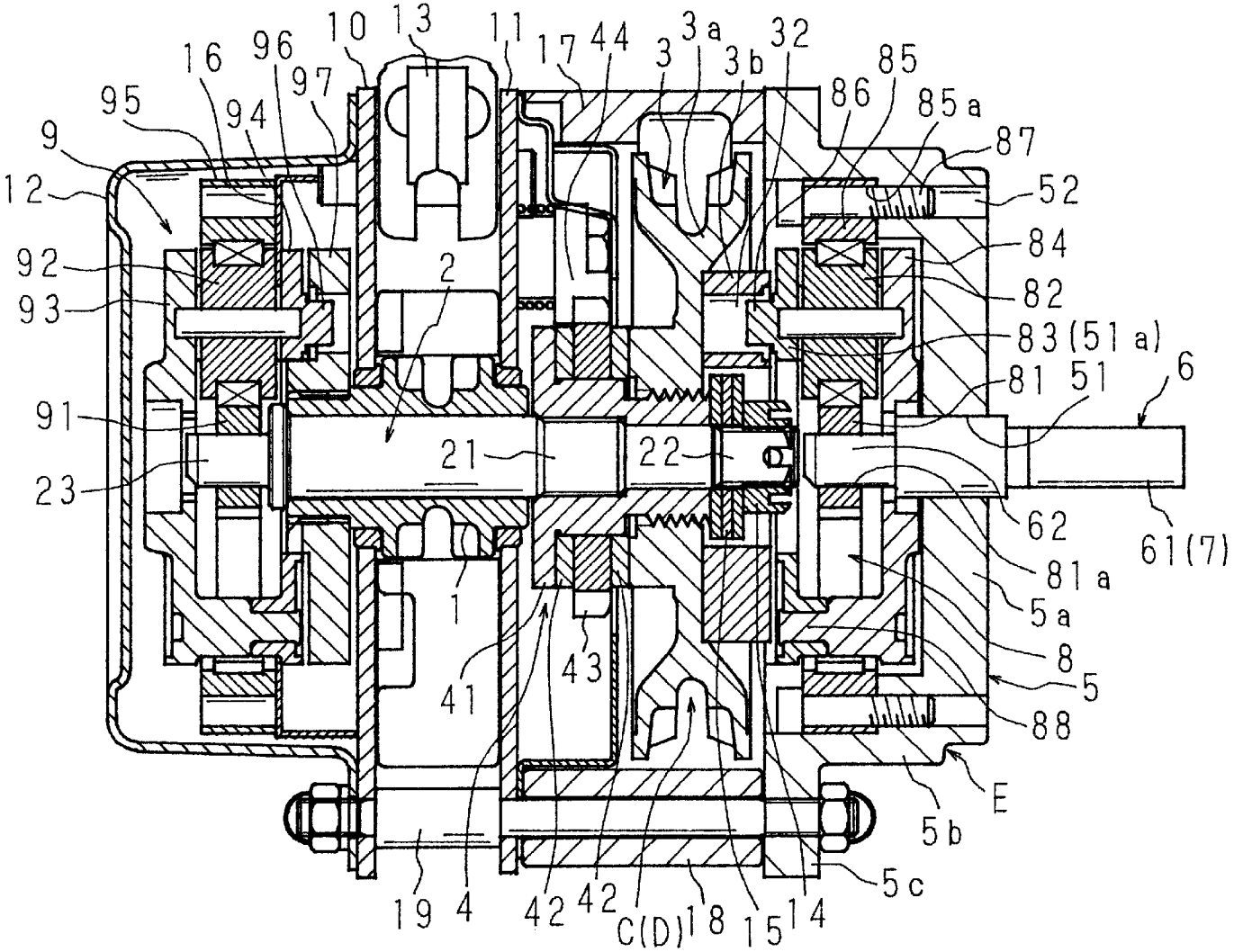
FIG. 2 is a cross-sectional view that shows a lifting gear of Embodiment 1 in accordance with the present invention.
Figure 3:
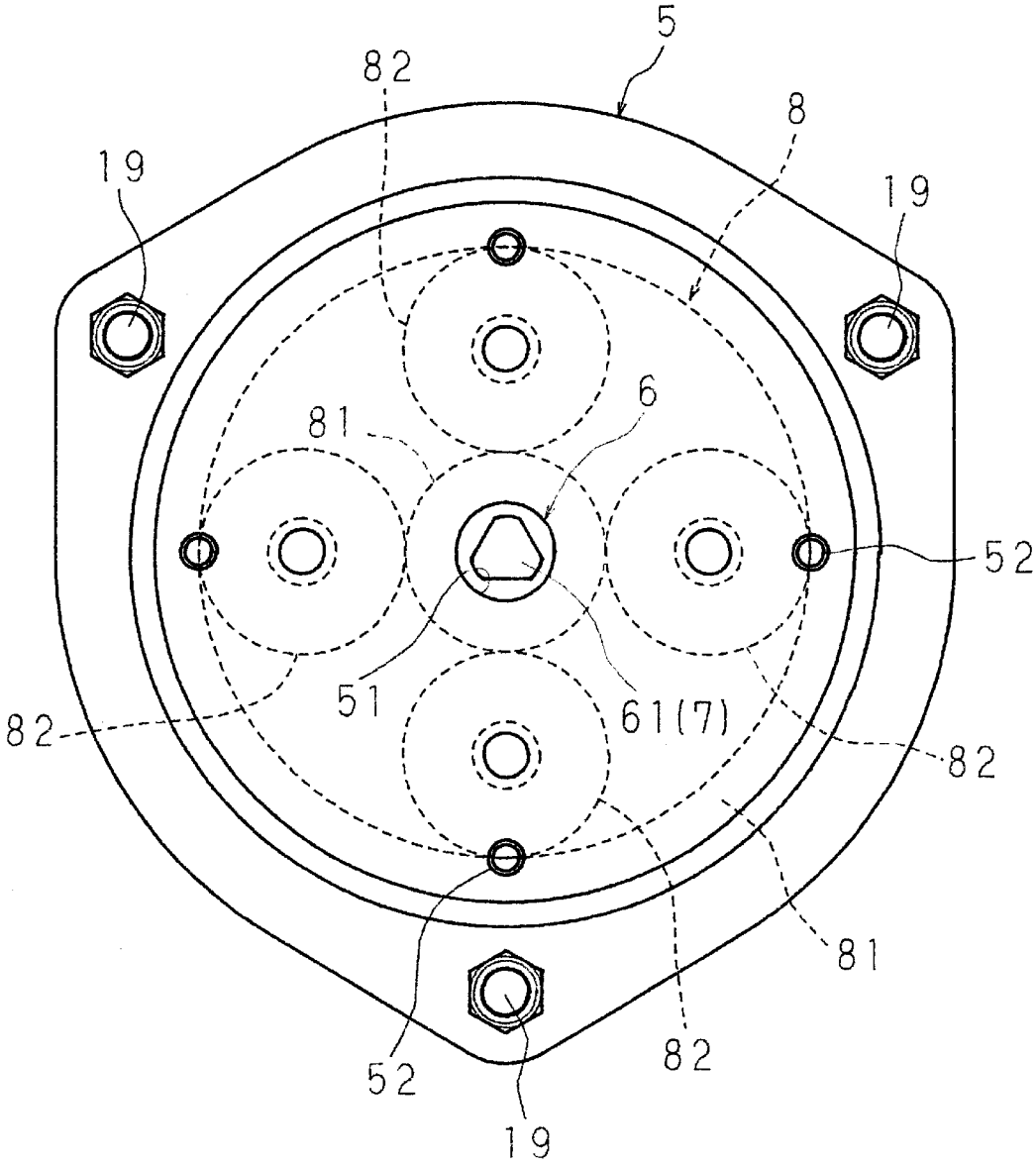
FIG. 3 is a side view that shows a ring body of the lifting gear of the present invention.

FIG. 2 is a cross-sectional view that shows a cross-sectional view of a lifting gear of the present invention, and FIG. 3 is a side view thereof. This lifting gear is achieved by modifying a generally-used manual-type lifting gear using a chain as its driving means. This lifting gear is provided with: a cylinder-shaped load-sheave 1 for shifting a sinuate body A such as a load chain in the longitudinal direction; a pair of side plates 10 and 11 that rotatably supports the load-sheave 1; a rotatable shaft body at transmission side 2 that penetrates the inside of the load-sheave 1; a ring body 3 that is threadedly engaged to one end of the shaft body 2 so as to rotate forwardly/reversely in an interlocked manner with the shifting operation of a chain a braking mechanism 4, placed between the ring body 3 and the side plate 11, which transmits the forward rotation of the ring body 3 to the shaft body 2, and applies a braking force to the reverse rotation of the shaft body 2; a cover body 5 for covering the ring body 3; and a power connecting portion 7 that can be coupled to a portable mechanical-driving equipment B. The lifting gear is also provided with: a shaft body at input side 6 that faces the shaft body at transmission side 2 inside the covet body 5 in the shaft length direction; a planetary reduction mechanism 8 that reduces the rotation of the shaft body 6 so as to transmit it to the ring body 3; a reduction gear mechanism 9 installed between the other end of the shaft body 2 and the load-sheave 1; a cover body 12 for covering the reduction gear mechanism 9; and a hook 13 that is supported between the side plates 10 and 11.

The shaft bodies 2 and 6, the ring body 3, the braking mechanism 4, the planetary reduction mechanism 8 and the reduction gear mechanism 9 constitute a rotary body C for rotating the load-sheave 1. The shaft body 2, the ring body 3, the braking mechanism 4, the planetary reduction mechanism 8 and the reduction gear mechanism 9 constitute an interlock body D for rotating the load-sheave 1. Moreover, the side plates 10 and 11 and the cover bodies 5 and 12 constitute a frame E that covers the load-sheave 1 and the rotary body C.

The load-sheave 1, the side plates 10 and 11, the shaft body 2 and the braking mechanism 4 are conventionally-used members, and the ring body 3 is formed by coupling a metal passive plate 3*b* to a conventionally-used hand chain wheel 3*a*. Here, the following description will briefly discuss the constructions and functions of these conventional members.

The load-sheave 1 is provided with a chain latch portion over which the load chain is passed and latched, and gear teeth that engage a transmission gear 97 of the reduction gear mechanism 9, and these members are located on the outer circumferential portion of its cylinder body.

The shaft body 2 is provided with a first screw portion 21 and a second screw portion 22 at one end that stretches outward from the load-sheave 1, and a collar for preventing fallout and a fitting portion 23 having a non-round shape at the other end thereof.

The braking mechanism 4 is provided with a flanged hub 41 that is threadedly engaged to the first screw portion 21 of the shaft body 2, a pair of brake linings 42 that are rotatably supported on the outer circumference of the flanged hub 41, a ratchet gear 43 that is rotatably interpolated between these brake linings 42, and a pawl body 44 that is supported by the side plate 11 so as to engage the ratchet gear 43; thus, the ring body 3 is threadedly engaged to the end opposite to the flange of the flanged hub 41 so as to rotate forwardly or reversely.

In this construction, when the brake linings 42 and the ratchet gear 43 are narrowed and pressed to each other by the forward rotation of the ring body 3 at the time of lifting a load, etc. so as to be integrally combined with the flanged hub 41, the shaft body 2 is allowed to forwardly rotate together with the flanged hub 41. When the rotation of the ring body 3 is stopped, the rotations of the flanged hub 41 and the shaft body 2 are stopped. Moreover, when the reverse rotation of the ring body 3 at the time of lowering a load, etc. allows the ring body 3 to depart from the brake linings 42, thereby releasing the above-mentioned stopping operation.

When the reverse rotation of the ring body 3 is stopped, a load exerted on the shaft body 2 through the load-sheave 1 and the reduction gear mechanism 9 generates thrust for allowing the shaft body 2 and the flanged hub 41 to reversely rotate and for also allowing the ring body 3 to shift toward the brake linings 42, and the thrust makes the ring body 3 shift toward the brake linings 42, thereby pressing and narrowing the brake linings 42 so as to be stopped as described above.

Figure 4:
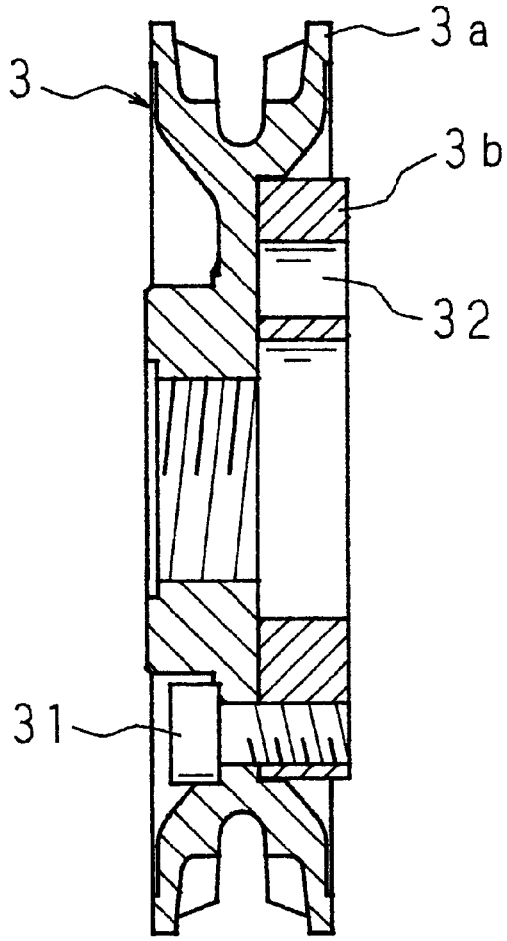
FIG. 4 is a cross-sectional view that shows the ring body of the lifting gear of the present invention.
Figure 5:
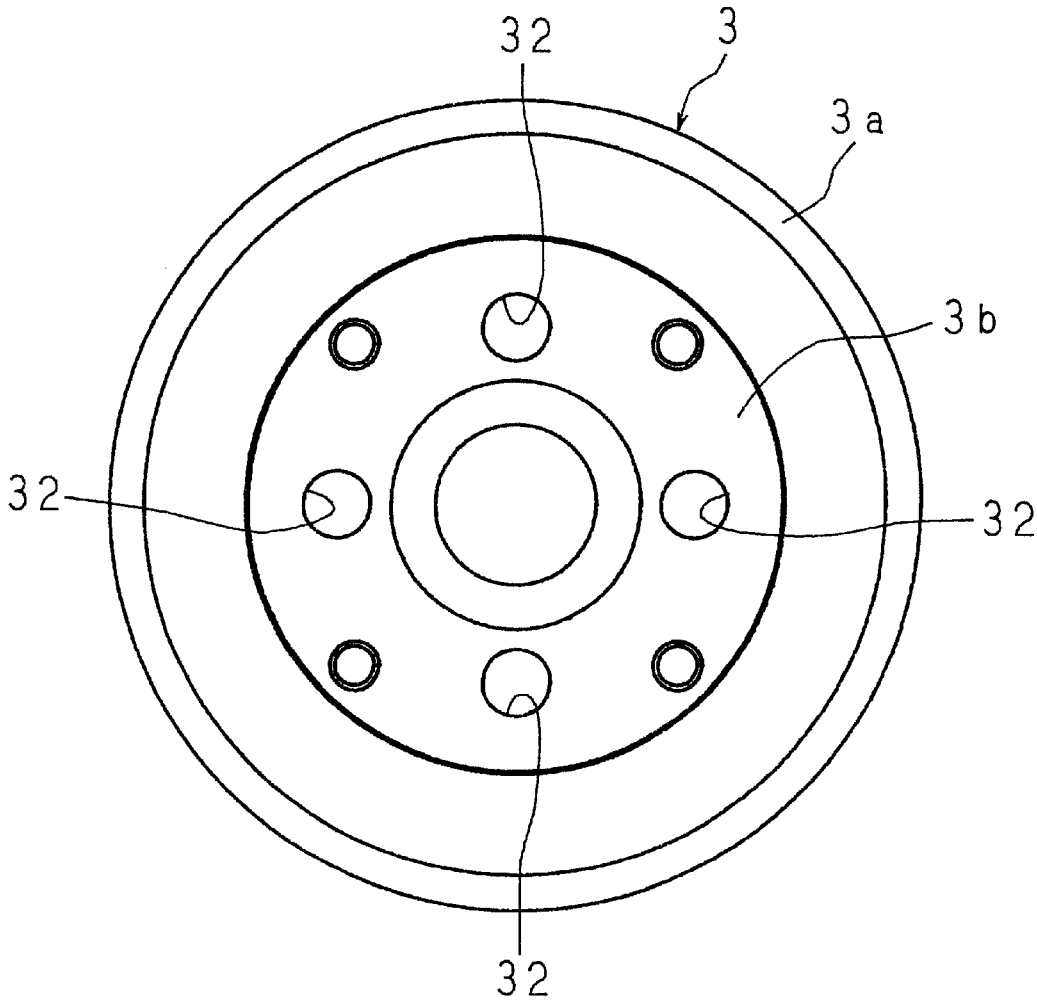
FIG. 5 is a side view that shows the ring body of the lifting gear of the present invention.

FIG. 4 is a cross-sectional view of the ring body 3 and FIG. 5 is a side view of the ring body 3. The ring body 3 has the metal passive plate 3*b* that is coupled to a hand wheel 3*a* having a threaded holes in the center and one side face of the hand chain wheel 3*a* with four bolts 31. The passive plate 3*b* has a ring shape, and a plurality (actually, four) of recessed passive sections 32 are provided in the circumferential direction with constant intervals on its one side face. Moreover, the ring body 3 is stopped from slipping off with an allowance of a predetermined reverse rotation by nuts 14 threadedly engaged to the second screw portion 22 of the shaft 2 and spacers 15 interpolated between the nuts 14 and the flanged hub 41.

The reduction gear mechanism 9 is provided with: an input gear 91 that is fitted to the fitting portion of the shaft body 2 so as to integrally rotate therewith; a plurality (actually, four) of planetary gears 92 that engage the input gear 91 and revolve around the input gear 91; a pair of holding bodies 93 and 94 for holding these planetary gears 92 with constant intervals, a ring-shaped sun gear 95 that supports the planetary gears 92 inside the cover body 5 so as to revolve inside thereof, and a ring-shaped transmission gear 97 having recessed portions that engage a plurality of protrusions 96 placed on one side of one of the holding body 93. The transmission gear 97 is allowed to engage the gear teeth of load-sheave 1, and the sun gear 95 is secured to a dish-shaped support base 16 having a penetration hole in the center thereof with four bolts, and the support base 16 is connected to the side plate 10; thus, it is constructed so as to reduce the rotation of the shaft body 2 to as to transmit it to the load-sheave 1.

Figure 6:
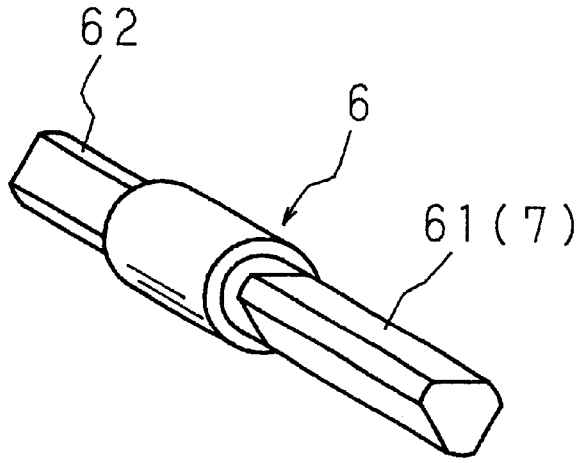
FIG. 6 is a perspective view that shows a shaft body at input side of the lifting gear of the present invention.

FIG. 6 is a perspective view of the shaft body 6. The shaft body 6, which is gripped by the chuck portion of the portable mechanical-driving equipment B using a charging-type electric driver b commercially available as an electric tool, is provided with a grip portion 61 sharedly used as the power connecting portion 7 at its one end, and a fitting portion 62 having a non-round shape at the other end thereof. The fitting portion 62 is inserted into the cover body 5 in a manner so as to be freely drawn therefrom, with the shaft body 6 facing the shaft body 2 in the shaft length direction.

Figure 7:
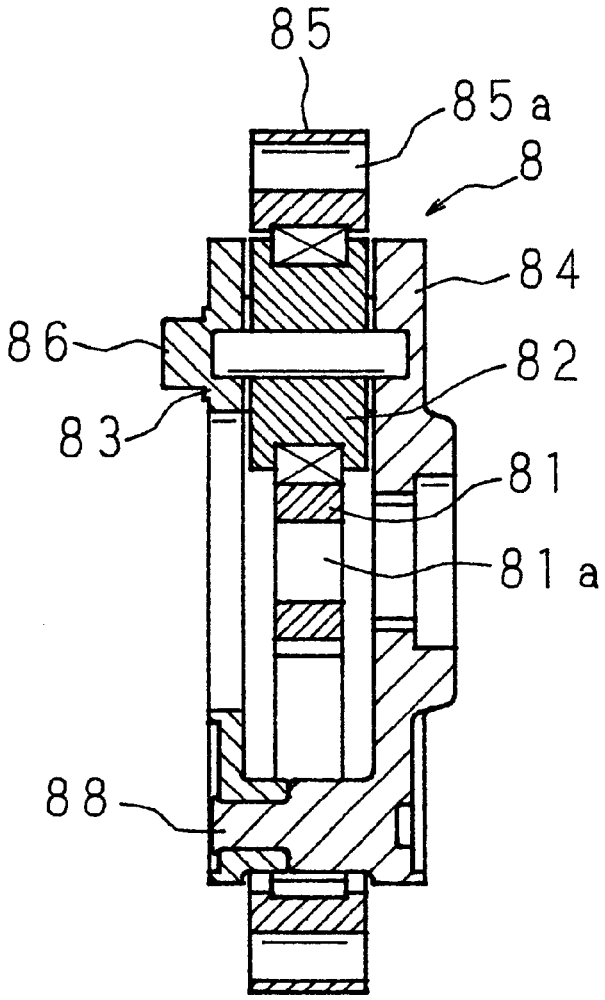
FIG. 7 is a cross-sectional view that shows a planetary reduction mechanism of the lifting gear of the present invention.
Figure 8:
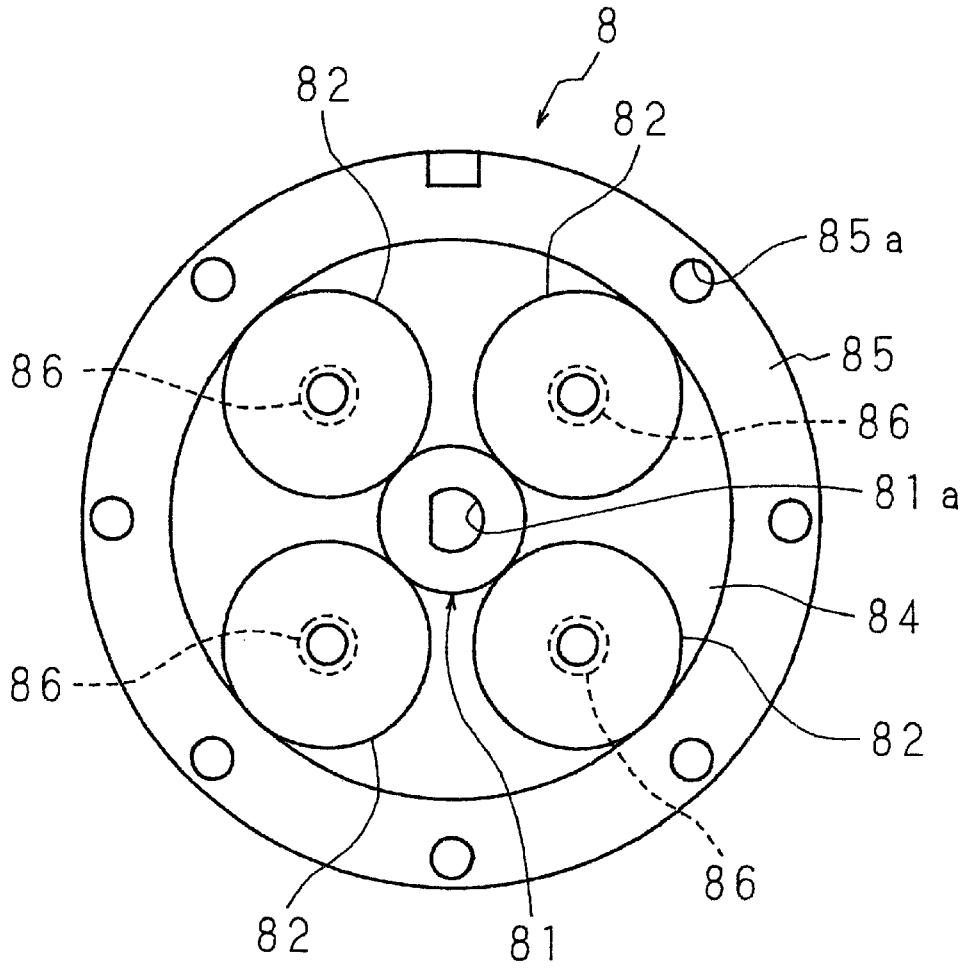
FIG. 8 is a side view that shows the planetary reduction mechanism of the lifting gear of the present invention.

FIG. 7 is a cross-sectional view showing the planetary reduction mechanism 8, and FIG. 8 is a side view of the planetary reduction mechanism 8. The planetary reduction mechanism 8 is provided with: an input gear 81 having a fitting hole 81*a* having a non-round shape that matches the fitting portion 62 in the center thereof; a plurality (actually, four) of planetary gears 82 that engage the input gear 81 and revolve around the input gear 81; a pair of holding bodies 83 and 84 for holding these planetary gears 82 with constant intervals; a ring-shaped sun gear 85 that supports the planetary gear 82 inside the cover body 5 so as to revolve inside thereof.

Moreover, a plurality of protrusions 86 that fit the passive portion 32 are placed on one side of the holding body 83. Thus, when the shaft body 6 fitted to the fitting hole 81*a* of the input gear 81 rotates, the input gear 81 is allowed to rotate, and the planetary gears 82 revolve along the inside of the sun gear 85 while rotating on themselves; thus, the revolution force is transmitted to the passive portion 32 of the ring body 3 through the protrusions 86 of the holding body 83 so that the ring body 3 is allowed to rotate at a reduced speed.

The sun gear 85 is provided with four penetration holes 85*a* formed with constant intervals, and secured to the inside of the cover body 5 by securing screws 87 that are inserted through these penetration holes 85*a*. Moreover, four connection members 88 are integrally formed on the holding body 84 with a different phase from the supporting position of the planetary gears 82, and ends of these connection members 88 are inserted through the penetration holes of the holding body 83 so that the holding bodies 83 and 84 are formed into an integral part by means of caulking.

Figure 9:
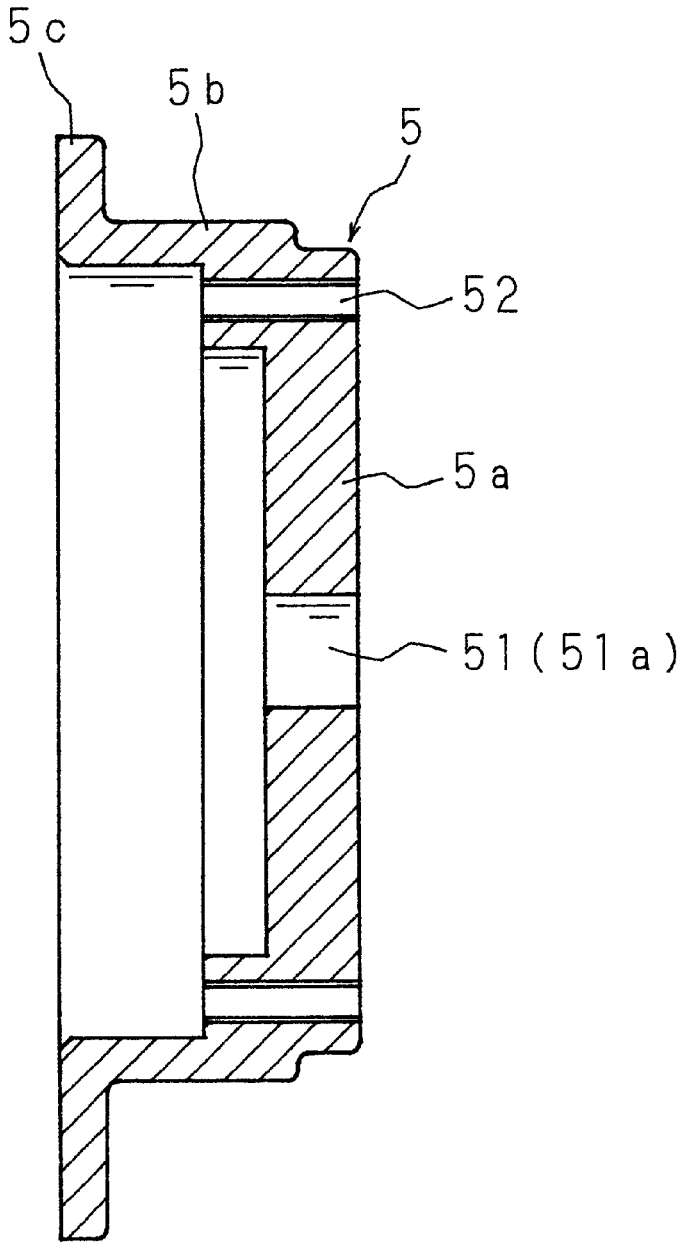
FIG. 9 is a cross-sectional view that shows a cover body of the lifting gear of the present invention.
Figure 10:
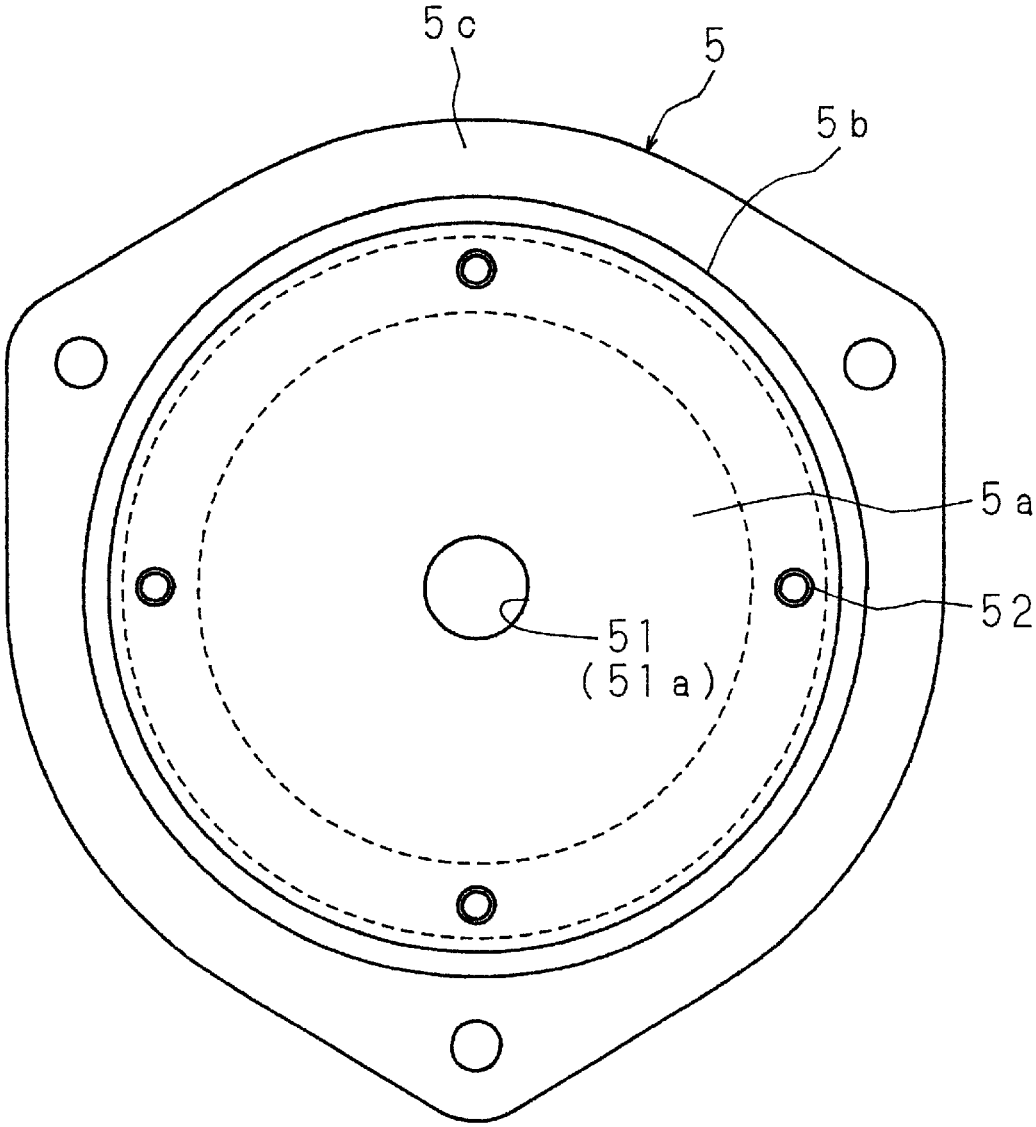
FIG. 10 is a side view that shows the cover body of the lifting gear of the present invention.

FIG. 9 is a cross-sectional view of the cover body 5, and FIG. 10 is a side view of the cover body 5. The cover body 5 is provided with: a chain guide plate 17 for guiding chain that is placed on the upper side (hook side) of the ring body 3 so as to be latched on the hand chain wheel 3*a*; a disk-shaped side wall 5*a* which is attached to the side plate 11 through a cylinder-shaped spacer 18 and three stay bolts 19, and which has a hole 51 formed in the center thereof through which the shaft body 6 is inserted in a manner so as to be freely drawn therefrom, and a threaded hole 52, formed on the circumferential portion thereof, to which the securing screw 87 is threadedly engaged; a cylinder portion 5*b* that connects the circumferential edge of the side wall 5*a*; and a flange 5*c* that connects the open edge of the cylinder portion 5*b*. The flange 5*c* is secured by the stay bolts 19, and the sun gear 85 is secured to the side wall 5*a*.

The lifting gear having the above-mentioned construction is applied to two cases, in which the chain, latched on the hand chain wheel 3*a* of the ring body 3, is used as the driving means for the load-sheave 1 and in which a charging-type electric driver b is used as the driving means therefor. The application of the chain makes it possible to drive the load-sheave 1 by a manual operation in the same manner as that of the manual type; and the application of the electric driver b makes it possible to drive the load-sheave 1 in the same manner as that of the generally-used electric type.

Upon application, in the same manner as that of the generally-used manual type, the hook 13, supported by the side plates 10 and 11, is hanged from a still member and an object is hooked on the hook of the load chain that has been passed over the load-sheave 1.

Figure 11:
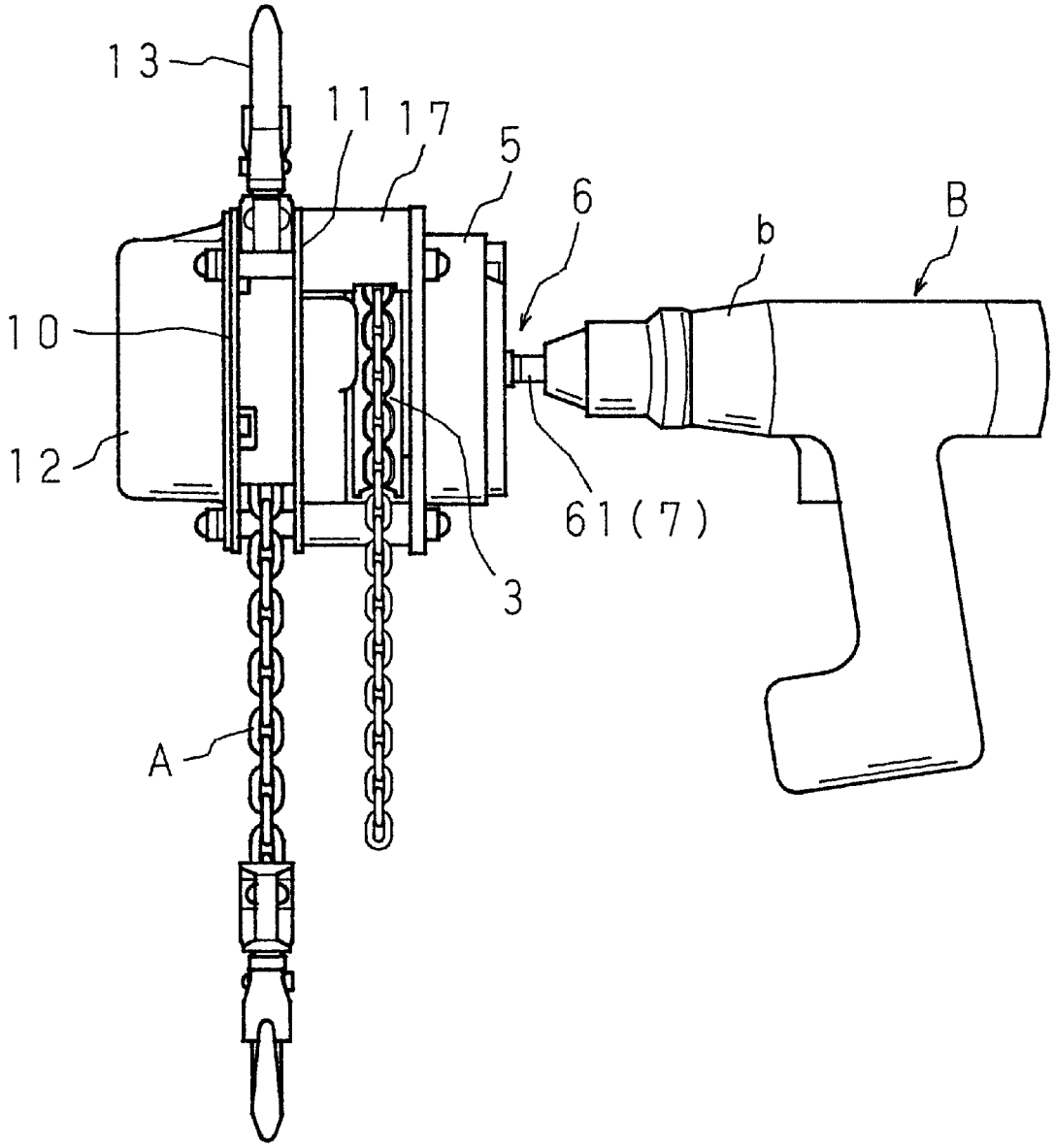
FIG. 11 is an explanatory drawing that shows a case in which an electric driver is operated in the vicinity of the lifting gear of the present invention.
Figure 12:
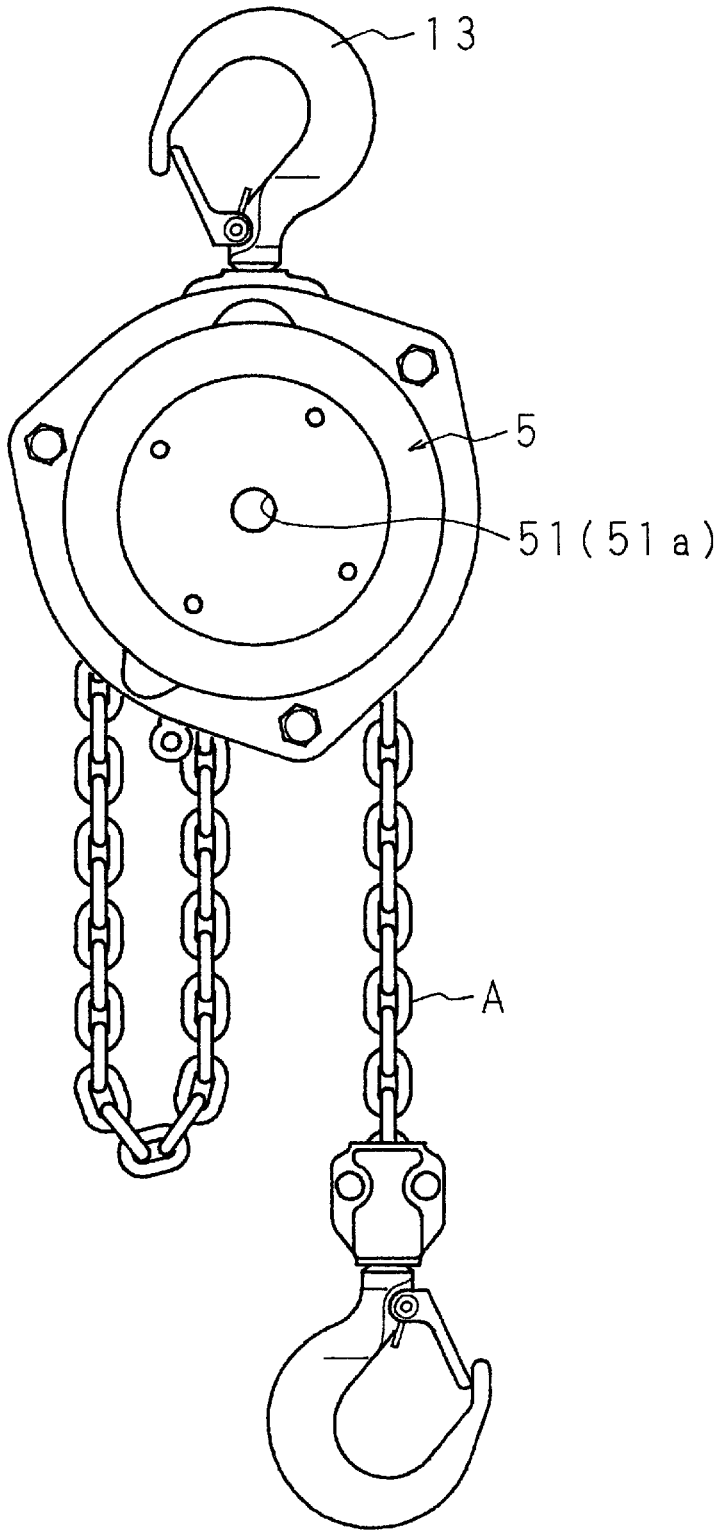
FIG. 12 is a side view that shows the entire construction of the lifting gear of the present invention.
Figure 13:
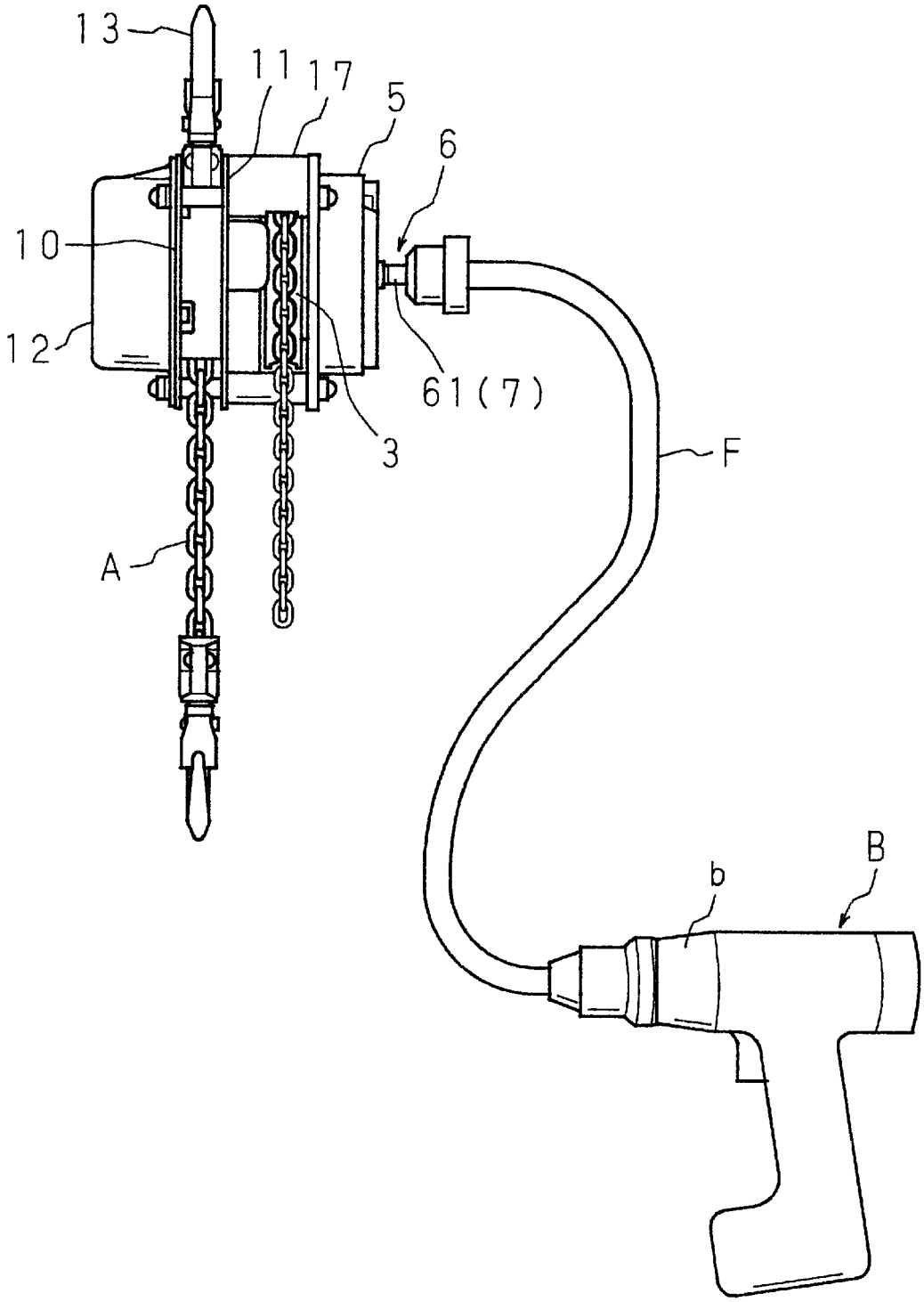
FIG. 13 is an explanatory drawing that shows a case in which the lifting gear of the present invention is remotely controlled by an electric driver having a flexible tube.
Figure 14:
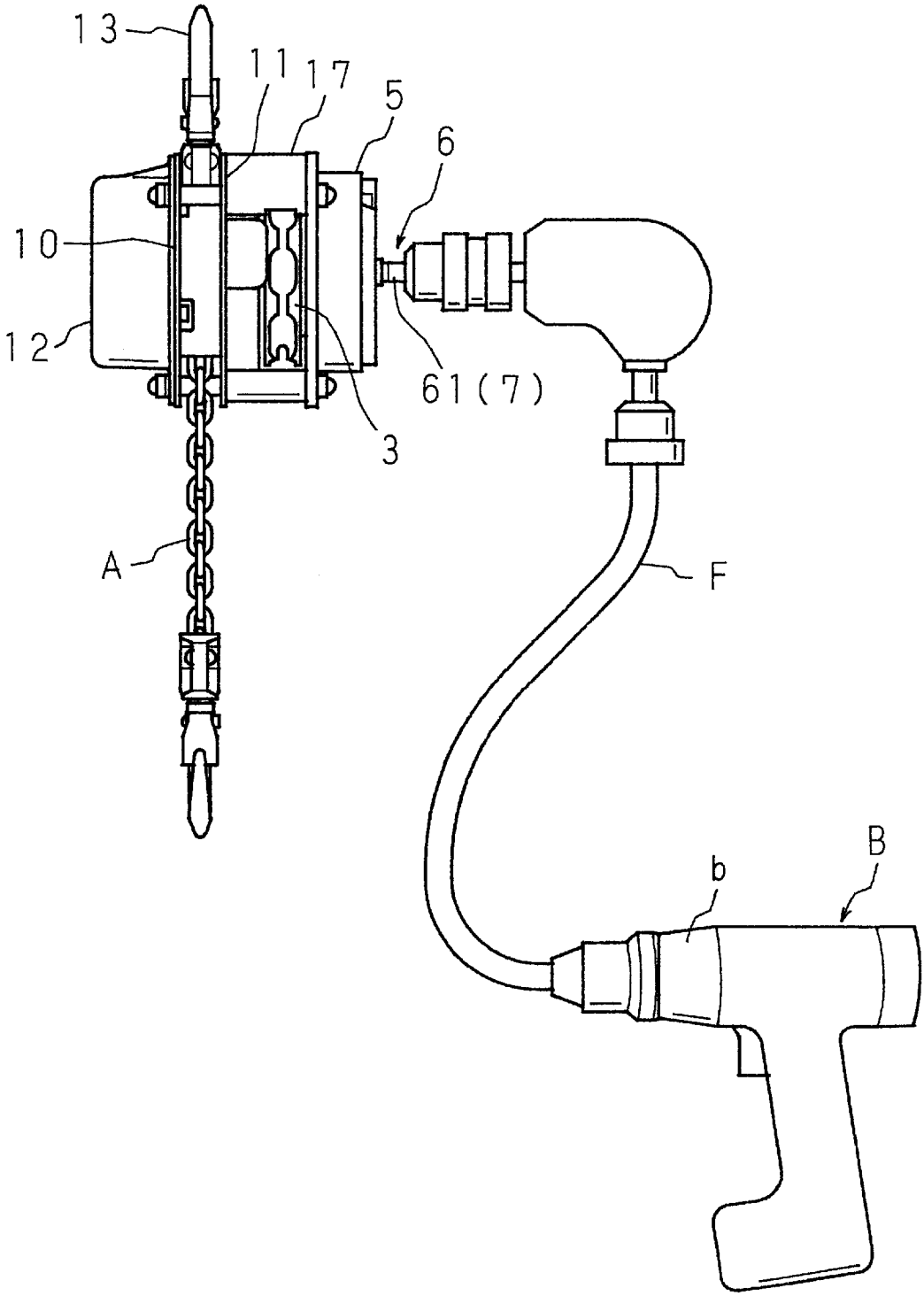
FIG. 14 is an explanatory drawing that shows a case in which the lifting gear of the present invention is remotely controlled by an electric driver having an L-shaped chuck and a flexible tube.

FIG. 11 is an explanatory drawing that shows a case in which an electric driver is operated in the vicinity of the lifting gear; FIG. 12 is a side view that shows the entire structure of the lifting gear; FIG. 13 is an explanatory drawing that shows a case in which a remote-control operation is carried out by using an electric driver having a flexible tube; and FIG. 14 is an explanatory drawing that shows a case in which a remote-control operation is carried out by an electric driver having an L-shaped chuck and a flexible tube.

In any of the applications, the power connecting portion 7 (grip portion 61) of the shaft body 6 is gripped by the chuck of the charging-type electric driver b. When the shaft body 6 is detached, its fitting portion 62 is inserted into the hole 51 of the cover body 5 so as to be fitted to the fitting hole 81*a* of the input gear 81.

When the electric driver b is rotated forwardly in this state, the rotation of the shaft body 6 is reduced by the planetary reduction mechanism 8, the ring body 3 is allowed to forwardly rotate at a low speed, and the rotation of the ring body 3 is transmitted to the shaft body 2 through the braking mechanism 4 having the brake linings 42, the ratchet gear 43 and the flanged hub 41, with the result that the rotation of the shaft body 2 is reduced by the reduction gear mechanism 9 so that the load-sheave 1 can be forwardly rotated at a low speed, thereby making it possible to lift the object through the load chain.

In the case when the driving operation of the electric driver b is stopped in the middle of this load lifting process, a load, which is exerted on the shaft body 2 through the load-chain, the load-sheave 1 and the reduction gear mechanism 9, causes a reverse rotation force on the shaft body-2 and the flanged hub 41, and also causes thrust that allows the ring body 3 to shift toward the brake linings 42; thus, the rotation of the shaft body 2 is stopped by the braking mechanism 4.

The commercially available electric driver b generally has a rotation speed that is too fast as compared with that of the generally-used manual lifting gear, and fails to provide a sufficient torque to lift a baggage of a predetermined load; however, since the rotation of the electric driver b is reduced by the planetary reduction mechanism 8, it is possible to rotate the ring body 3 at low speeds in the same manner as that of the generally-used manual type, and consequently to generate a greater torque that is sufficient to lift a baggage of a predetermined load.

Moreover, when the electric driver b is reversely rotated, the ring body 3 is allowed to depart from the brake linings 42 while reversely rotating at low speeds, the stopping operation of the braking mechanism 4 is released, with the result that the load-sheave 1, the shaft body 2 and the flanged hub 41 is reversely rotated by the gravity of an object, thereby making it possible to lower the baggage. In the case when the driving operation of the electric driver b is stopped in the middle of this lowering process, the reverse rotation is applied by the reverse rotation force exerted on the shaft body 2 and the flanged hub 41 as described above and the thrust that allows the ring body 3 to shift toward the brake linings 42 is exerted so that the ring body 3 is shift ed toward the brake linings 42 by the thrust so that the brake linings 42 are pressed and sandwiched, thereby stopping the lifting gear.

As described above, in Embodiment 1, a chain is passed over and latched on the ring body 3 so that the lifting gear is used as that of the manual-type using the chain, and the lifting gear is also used as that of an easy electric type using the electric driver b by inserting the shaft body 6 into the hole 51. Since the electric driver b needs not be incorporated into the frame E, the lifting gear is compact and light-weight as compared with those of the electric type, and easily applicable to cases other than those hanged from the ceiling, and it is constructed at low costs.

Moreover, as illustrated in FIG. 13 and FIG. 14, since an electric driver b having a flexible tube F can be used, it is possible to drive the load-sheave 1 by using a remote-control operation in the same manner as that of the generally-used manual type using a chain as the driving means.

Embodiment 2

Figure 15:
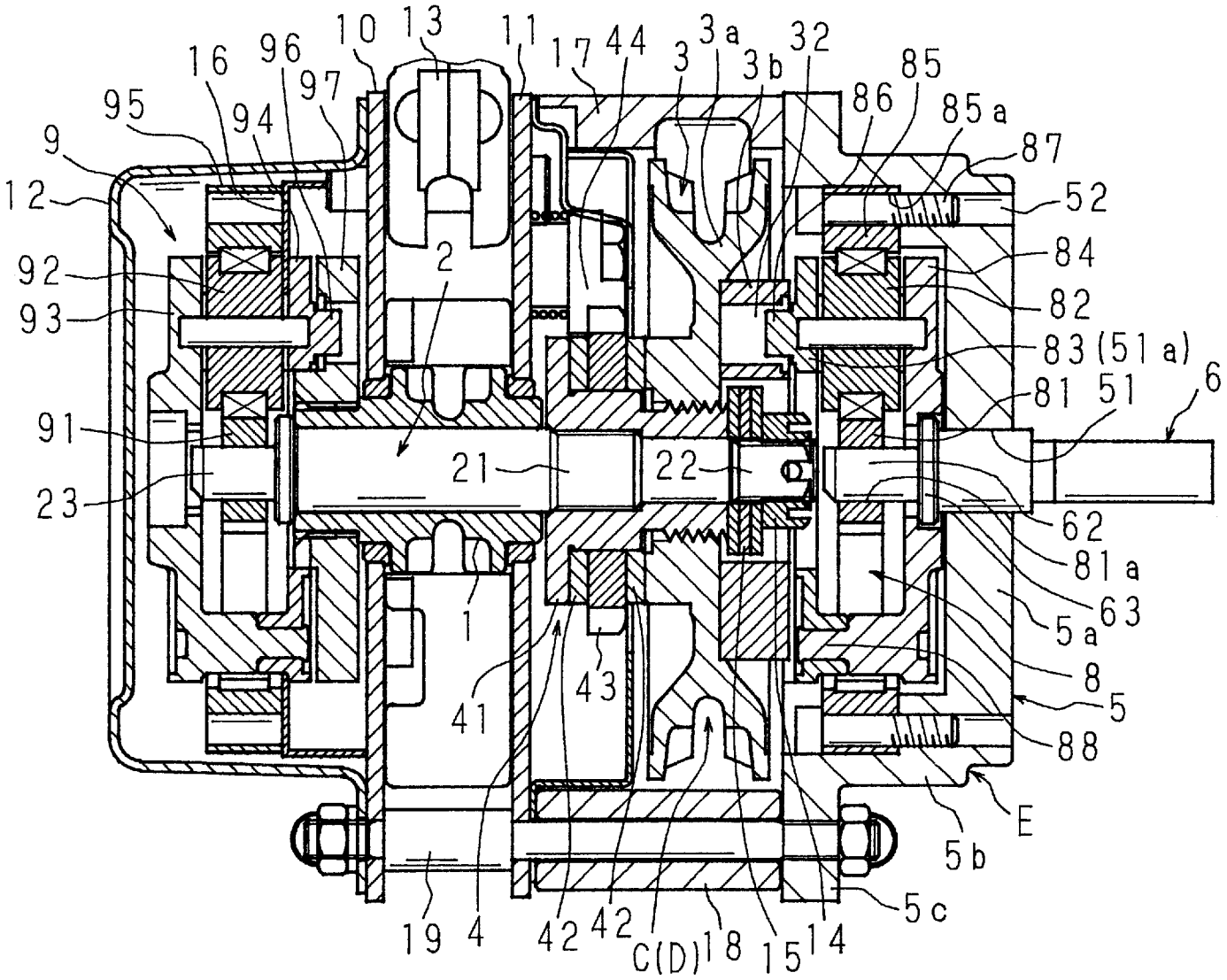
FIG. 15 is a cross-sectional view that shows a lifting gear of Embodiment 2 in accordance with the present invention.

FIG. 15 is a cross-sectional view that shows a lifting gear. In this lifting gear of the present invention, the shaft body 6 is held in the hole 51 of the cover body 5 so that it is arranged so as not to be removed outside of the cover body 5. Here, in the present embodiment, those members that have the same functions, constructions and effects and that are described in embodiment 1 by reference to FIGS. 2 through 14 are indicated by the same reference numerals and the description thereof is omitted.

Figure 16:
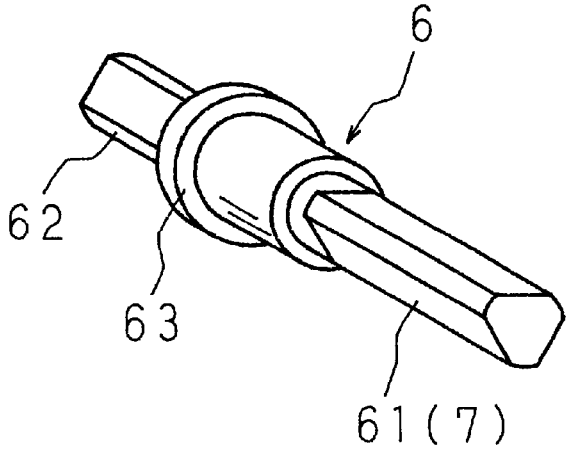
FIG. 16 is a perspective view that shows a shaft body at input side of the lifting gear of the present invention.

FIG. 16 is a perspective view that shows the shaft body at input side 6. In the shaft body 6, the grip portion 61, attached to one end thereof, is sharedly used as the power connecting portion 7, and a flange 63, which has a diameter larger than the hole 51, is placed in the vicinity of the fitting portion 62 having a non-round shape on the other end. The power connecting portion 7 is inserted through the hole 51 from the inside of the cover body 5 to the outside thereof, while the flange 63 stops it from being drawn out; thus, the power connecting portion 7 is designed so as to be gripped by the chuck portion of a charging-type electric driver b. After the shaft body 6 has been inserted through the hole 51, the planetary reduction mechanism 8 is inserted into the cover body 5 and the sun gear 85 is secured to the side wall 5*a*.

In Embodiment 2, since provision is made to prevent the shaft body at input side 6 from being drawn out of the cover 5, it is possible to prevent the shaft body 6 from being missing.

Embodiment 3

Figure 17:
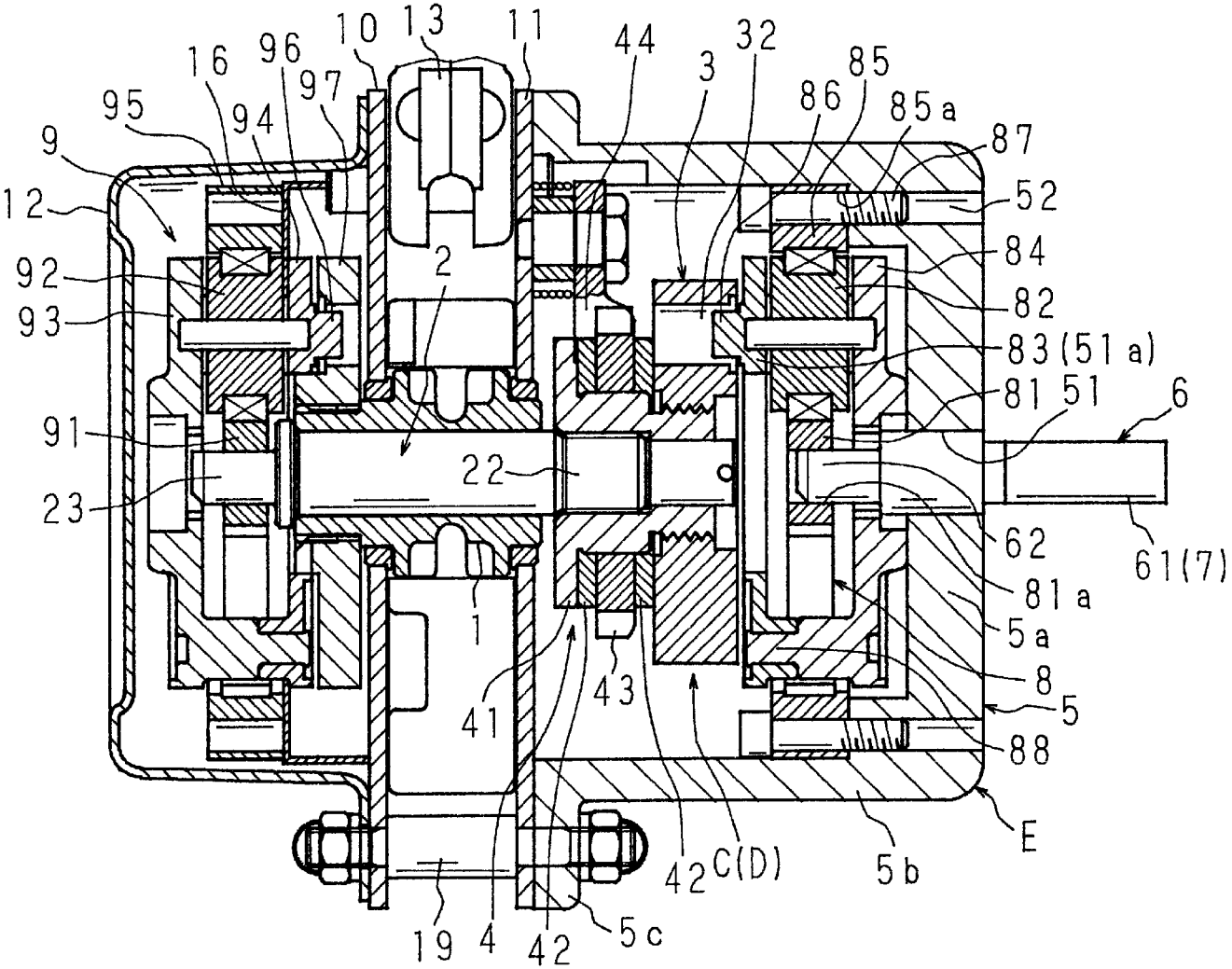
FIG. 17 is a cross-sectional view that shows a lifting gear of Embodiment 3 in accordance with the present invention.

FIG. 17 is a cross-sectional view of a lifting gear. In the lifting gear of Embodiment 3, the ring body 3 is formed into a ring-shape with the latch portion being cut out so that only the portable mechanical-driving equipments B such as charging-type electric drivers b are applied as the driving means for the load-sheave 1. Here, the chain guide is omitted therefrom, and the ring body 3, the braking mechanism 4 and the planetary reduction mechanism 8 are covered with the cover body 5. In the present Embodiment, those members that have the same functions, constructions and effects and that are described in embodiment 1 by reference to FIGS. 2 through 14 are indicated by the same reference numerals and the description thereof is omitted.

The ring body 3 is formed by using a ring-shaped metal plate with a threaded hole in the center thereof, and a plurality (actually, four) of passive portions 32 that penetrate middle portions thereof in the radial direction are formed in the circumferential direction with constant intervals.

The cover body 5, which has a hole 51 in the center thereof, is provided with: a disk-shaped side wall 5*a* having a threaded hole 52 in the circumferential portion, a cylinder portion 5*b* that connects the circumferential edge of the side wall 5*a* and a flange 5*c* that connects the open end of the cylinder portion 5*b*. The flange 5*c* is detachably attached to the side plate 11 with stay bolts 19.

In Embodiment 3, different from the construction of Embodiment 1, it is not necessary to provide a cut-out path through which the chain is shifted in the cover body 5; therefore, the cover body 5 is allowed to have a better shielding property.

Embodiment 4

Figure 18:
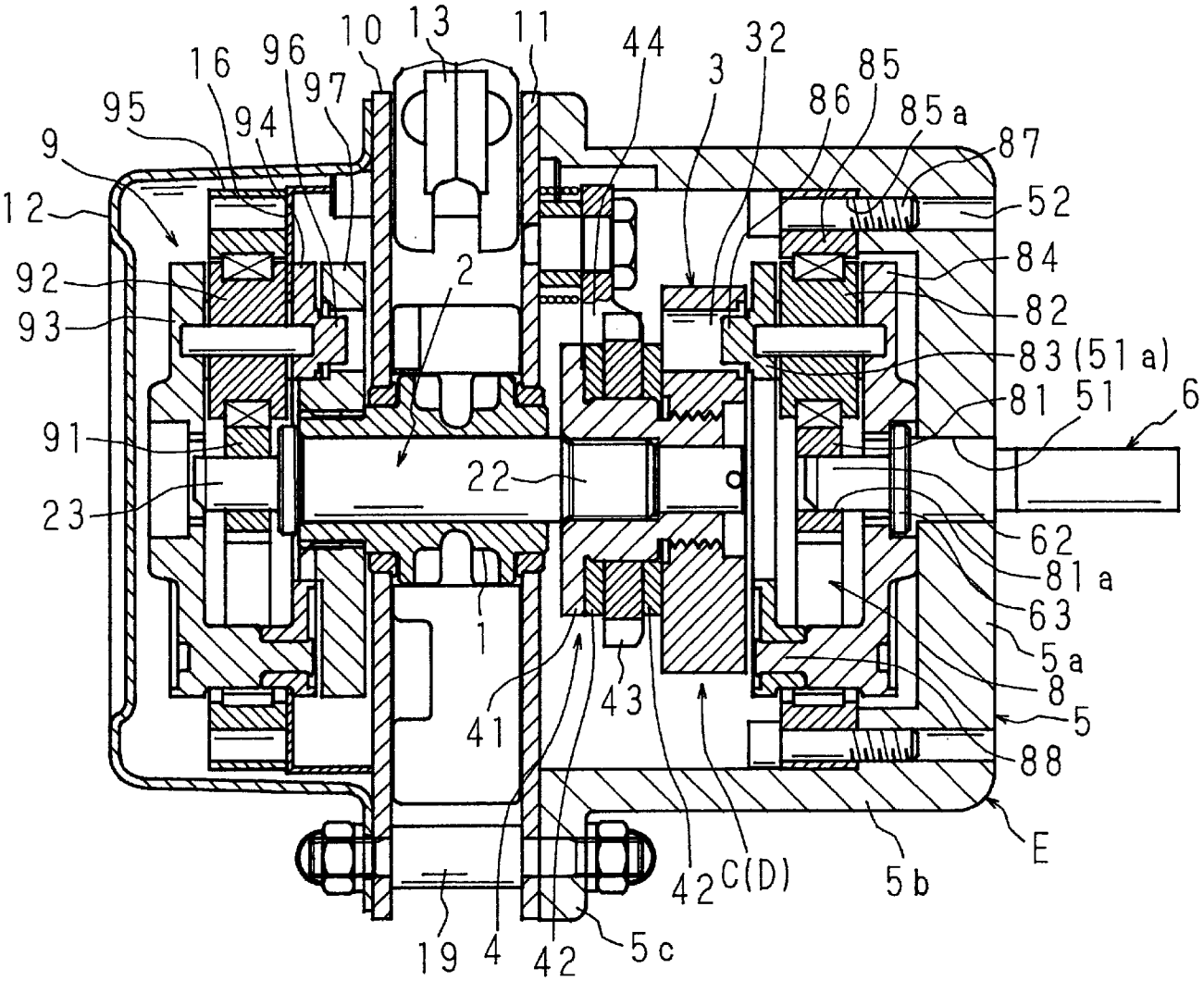
FIG. 18 is a cross-sectional view that shows a lifting gear of Embodiment 4 in accordance with the present invention.

FIG. 18 is a cross-sectional view of a lifting gear. In the lifting gear of Embodiment 4, in the same manner as Embodiment 2, the shaft body at input side 6 of Embodiment 3 is held in the hole 51 of the cover body 5 so as not to be drawn outside therefrom. In the present embodiment, those members that have the same functions, constructions and effects and that are described in Embodiments 1 and 2 by reference to FIGS. 2 through 14 are indicated by the same reference numerals and the description thereof is omitted.

Additionally, in Embodiments 2 and 4, instead of holding the shaft body at input side 6 in the hole 51 of the cover body 5, the power connecting portion 7 that is to be inserted into the hole 51 may be formed as an integral part with the input gear 81.

Embodiment 5

Figure 19:
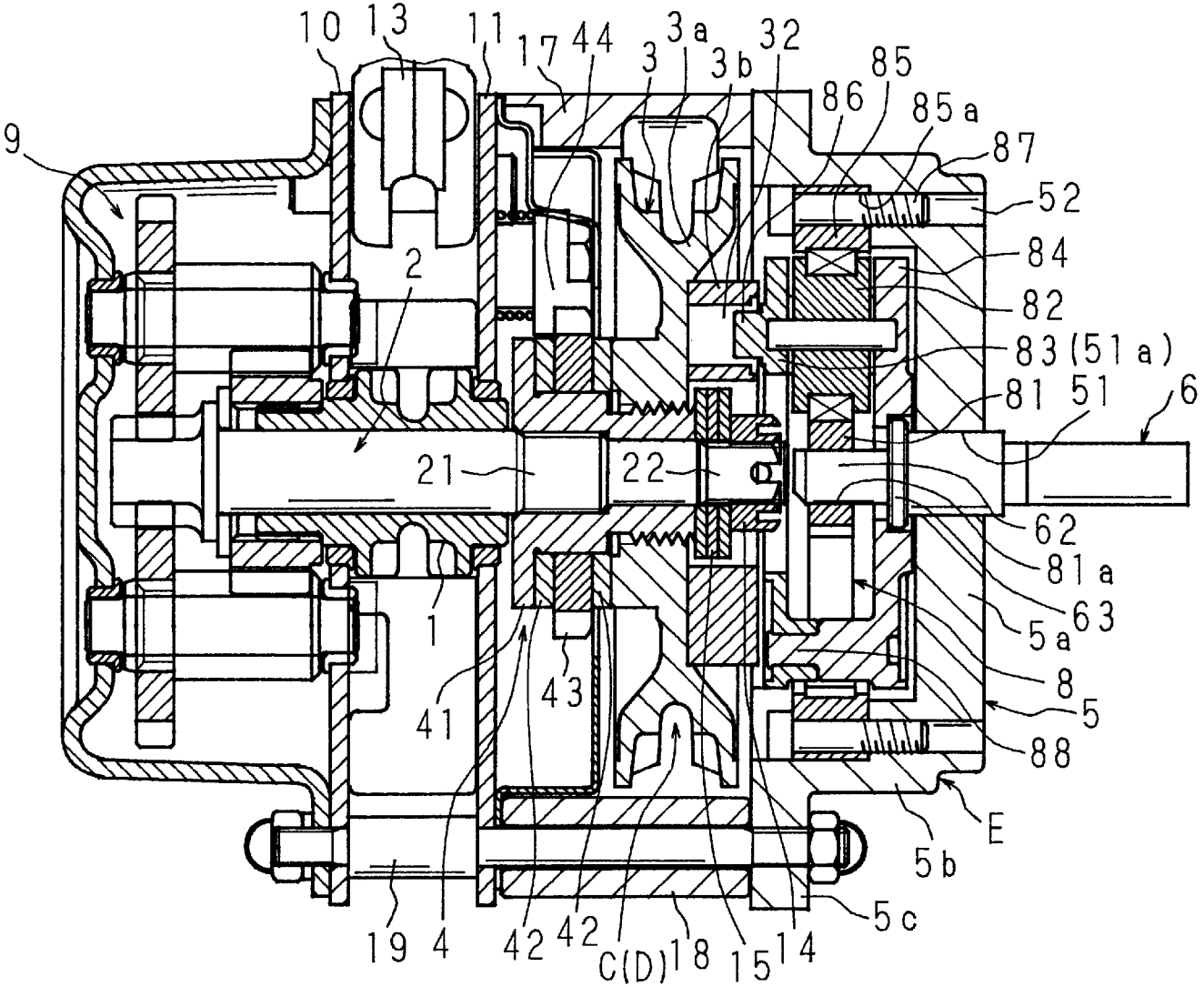
FIG. 19 is a cross-sectional view that shows a lifting gear of Embodiment 5 in accordance with the present invention.

FIG. 19 is a cross-sectional view of a lifting gear. In the lifting gear of Embodiment 5, instead of using.planetary gears in the reduction gear mechanism 9 of Embodiment 2, a plurality of spur gears 98 are used in the same manner as the prior art shown in FIG. 1. Since the other constructions and functions are the same as those described in Embodiments 1 and 2 by reference to FIGS. 2 through 14, those same parts are indicated by the same reference numerals, and the description thereof is omitted.

The reduction gear mechanism 9 of Embodiment 5 may be applied to Embodiments 1, 3 and 4.

In Embodiments 1 to 5, the cover body 5 has a construction in which a disk-shaped side wall 5*a* having a hole 51 in the center and a cylinder portion 5*b* connecting the circumferential edge of the side wall 5*a* are installed; however, in addition to this construction, for example, another construction may be proposed in which a cylinder section 5*b* is provided with the side wall 5*a* being omitted so as to allow the power connecting portion 7 installed on the input gear 81 to expose to the outside. Moreover, the cover body 5 may be omitted.

Embodiment 6

Figure 1:
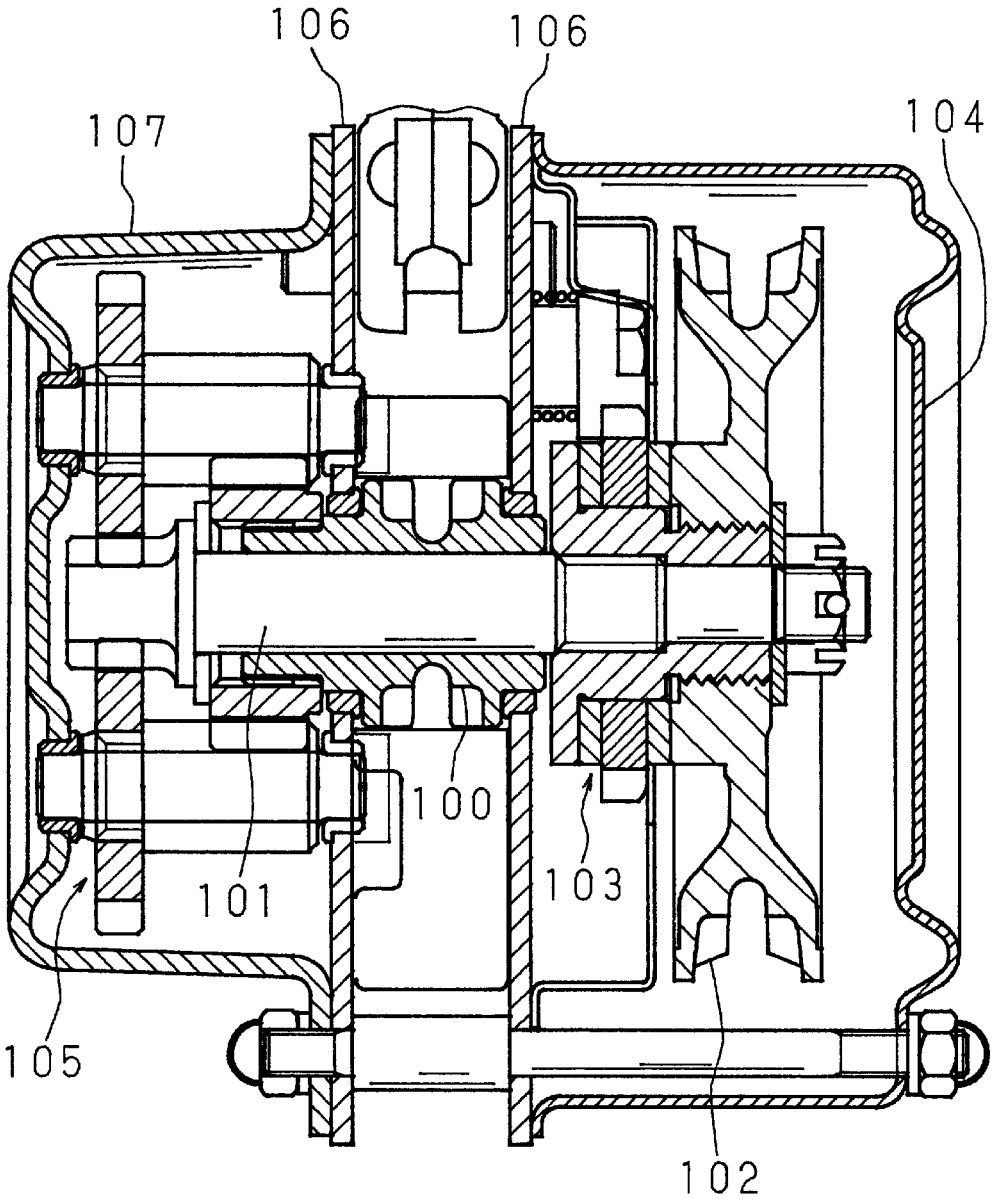
FIG. 1 PRIOR ART
FIG. 1 is a cross-sectional view that shows a prior art construction of a lifting gear.
Figure 20:
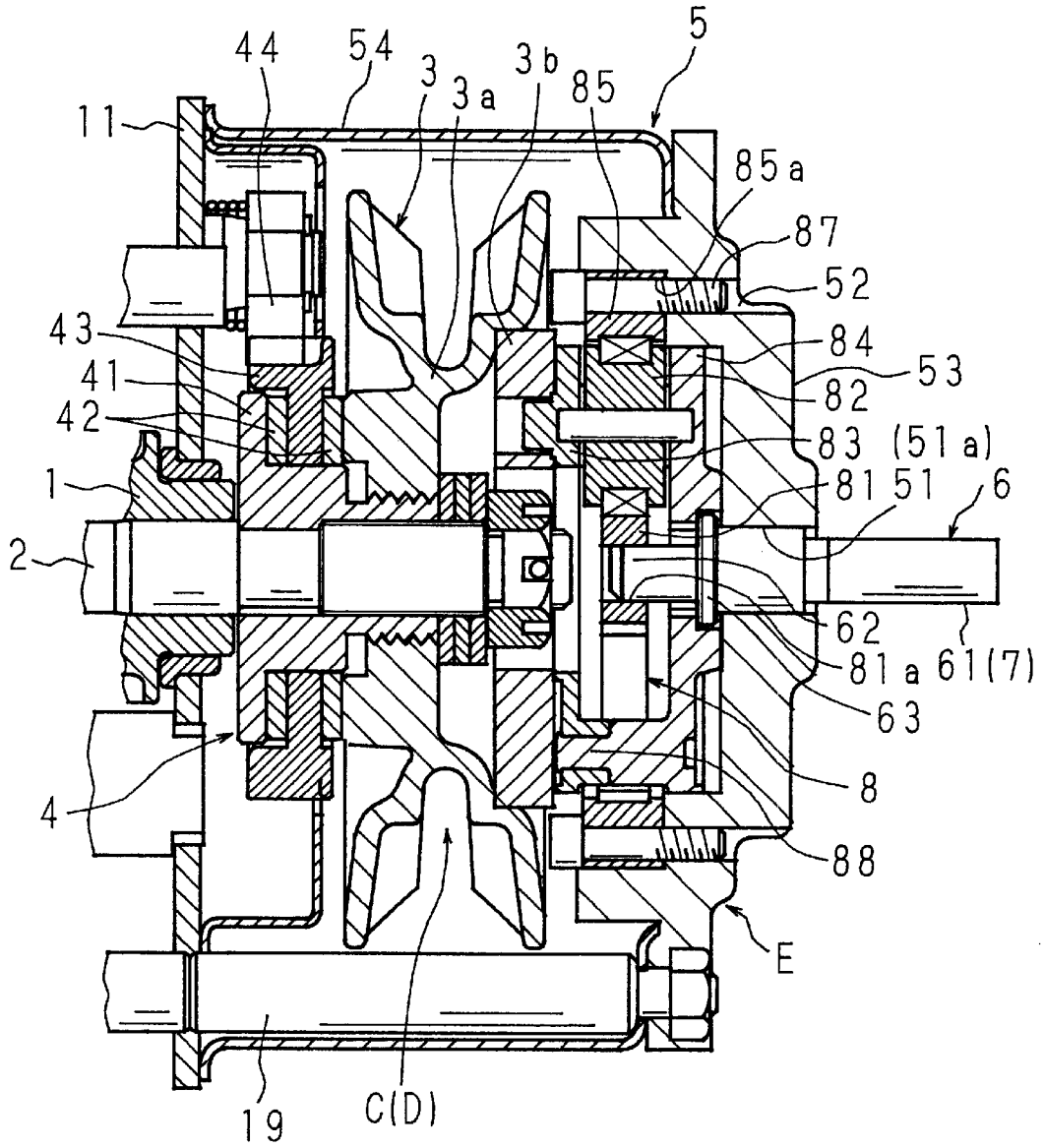
FIG. 20 is a cross-sectional view that shows a lifting gear of Embodiment 6 in accordance with the present invention.

FIG. 20 is a cross-sectional view from which the left half of a lifting gear is omitted. In the same manner as the prior art as shown in FIG. 1, in the lifting gear of Embodiment 6, one portion of the side wall of the cover body 5 of Embodiments 2 and 5 is cut out and another side wall 53 is attached to the cut-out portion. Since the other constructions and functions are the same as those described in Embodiments 1 and 2 by reference to FIGS. 2 through 14, those same parts are indicated by the same reference numerals, and the description thereof is omitted.

The cover body 5 is provided with a cylinder portion 54 having a pair of insertion holes (not shown) through which the chain to be latched over the hand chain wheel 3*a* is inserted, and a side wall 53 that closes one of the open portions of the cylinder portion 54. The side wall 53 and the cylinder portion 54 are detachably attached to the side plate 11 with three stay bolts 19.

The cover body 5 of Embodiment 6 may be applied to Embodiments 2 and 5.

Embodiment 7

Figure 21:
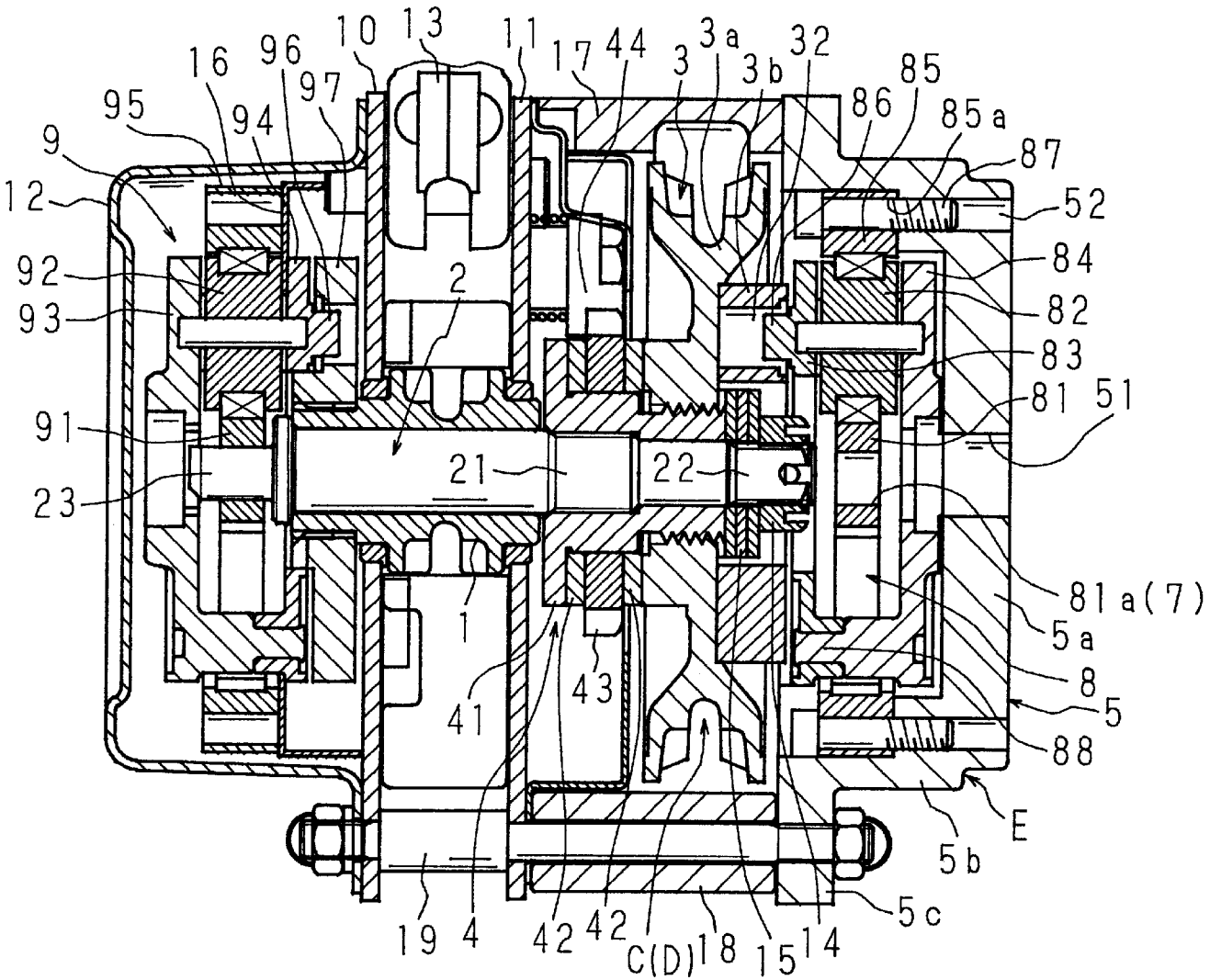
FIG. 21 is a cross-sectional view that shows a lifting gear of Embodiment 7 in accordance with the present invention.

FIG. 21 is a cross-sectional view of a lifting gear. In this lifting gear of Embodiment 7, instead of installing the power connecting portion 7 on the shaft body 6 with the shaft body 6 of Embodiments 1 and 3 being omitted, the fitting hole 81*a* of the input gear 81 of the planetary reduction mechanism 8 is allowed to serve as the power connecting section 7 so that the driving shaft portion of a portable mechanical-driving equipment B such as an electric driver b, etc. is fitted by the power connecting portion 7. Since the other constructions and functions are the same as those described in Embodiment 1 by reference to FIGS. 2 through 14 and Embodiment 3 by reference to FIG. 17, those same parts are indicated by the same reference numerals, and the description thereof is omitted.

Embodiment 8

In the lifting gear of Embodiment 8, the hole 51 of Embodiments 1 through 6 is used as a fitting hole 51*a* to which the shaft body at input side 6 is rotatably fitted. Since the other constructions and functions are the same as those described in Embodiments 1 through 6 by reference to FIGS. 2 through 20, those same parts are indicated by the same reference numerals, and the description thereof is omitted.

In the Embodiment 8, a portable mechanical-driving equipment B is coupled to the power connecting section 7, and even if a bending load is imposed on the shaft body 6 while the power of the portable mechanical-driving equipment is being transmitted to the shaft body 6, the bending load is released from the shaft body 6 and applied to the fitting hole 51*a*; thus, it becomes possible to properly prevent damages to the shaft body 6 due to the bending load.

Embodiment 9

Figure 22:
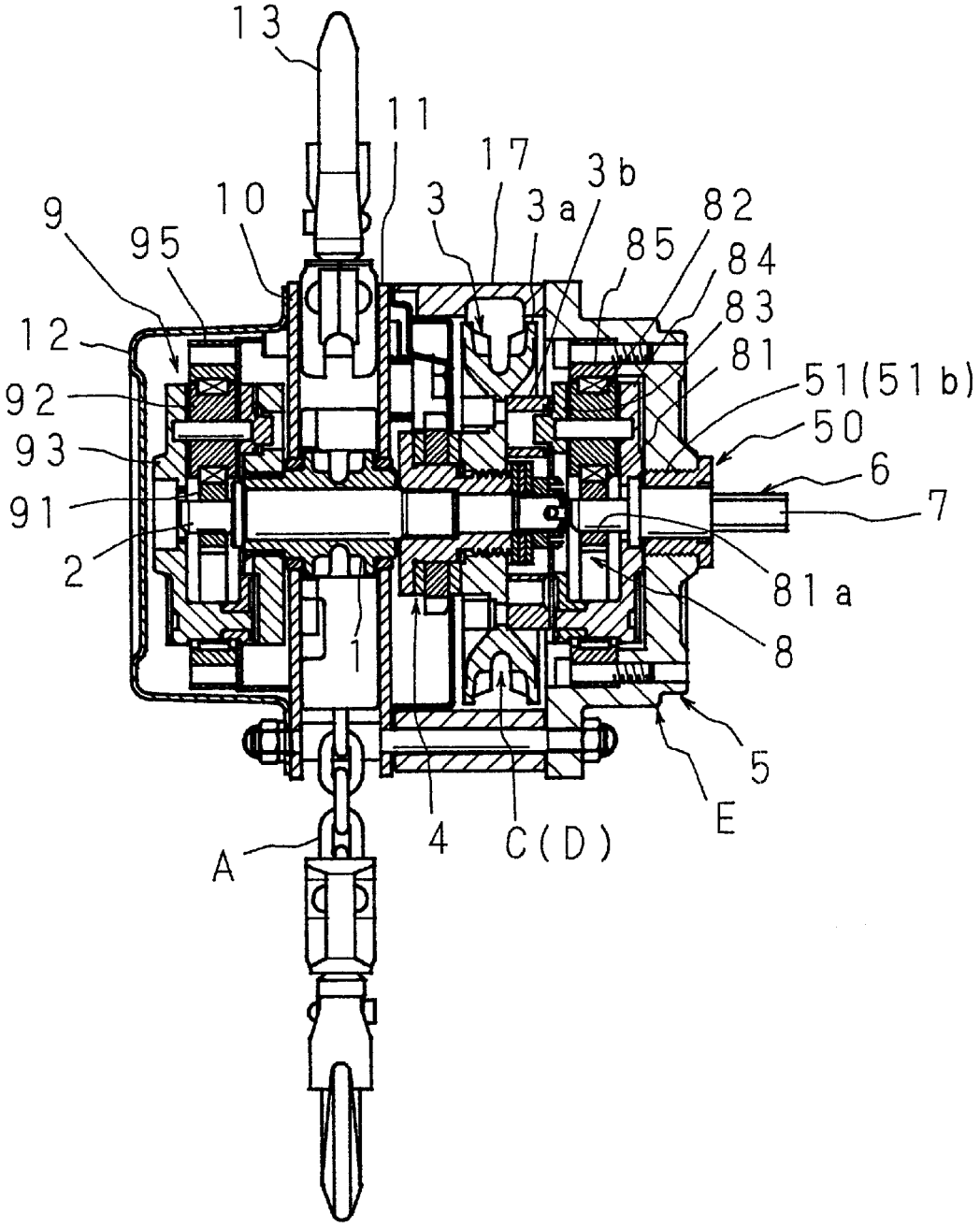
FIG. 22 is a cross-sectional view that shows a lifting gear of Embodiment 9 in accordance with the present invention.
Figure 23:
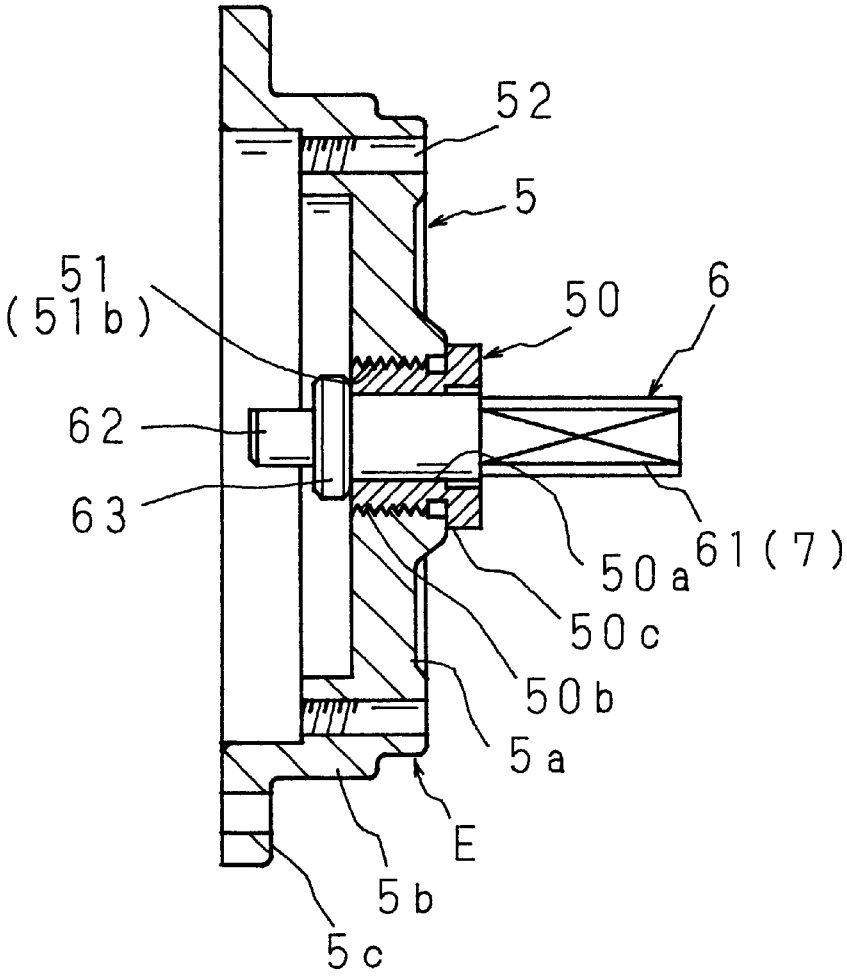
FIG. 23 is an enlarged cross-sectional view that shows a cover body and a shaft body of the lifting gear in accordance with the present invention.
Figure 24:
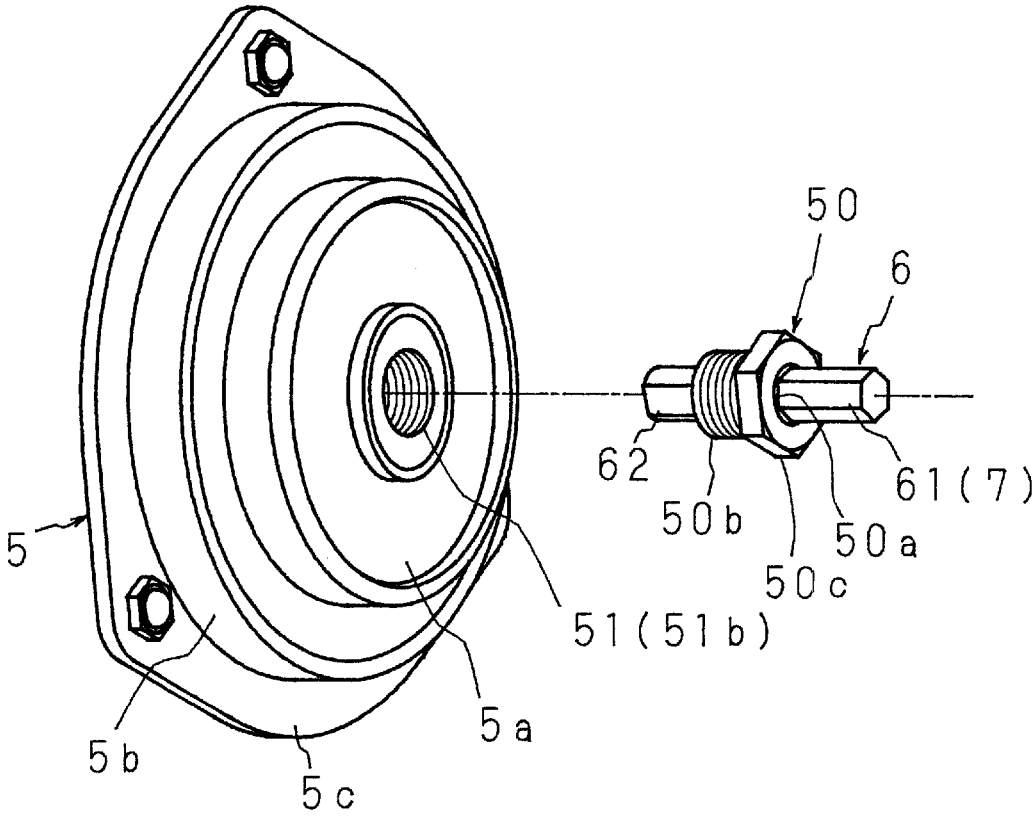
FIG. 24 is a perspective exploded view that shows the cover body and the shaft body of the lifting gear in accordance with the present invention.
Figure 25:
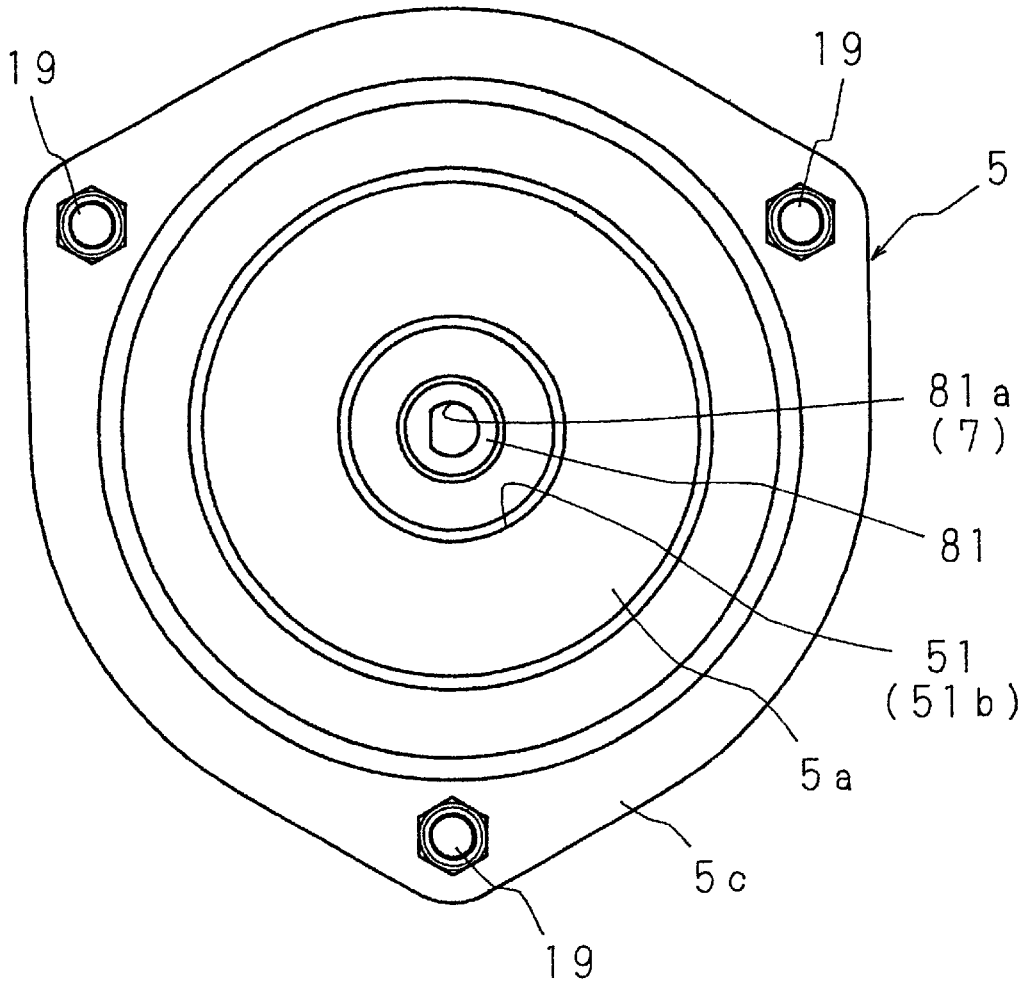
FIG. 25 is an enlarged side view that shows the cover body with the shaft body being removed therefrom in the lifting gear in accordance with the present invention.

FIG. 22 is a cross-sectional view of a lifting gear, FIG. 23 is an enlarged cross-sectional view showing the cover body 5 and the shaft body 6, FIG. 24 is a perspective exploded view showing the cover body 5 and the shaft body 6, and FIG. 25 is an enlarged side view of the cover 5 from which the shaft body 6 has been removed.

In the lifting gear of Embodiment 9, the hole 51 of Embodiments 2, 5 and 6 is provided as a threaded hole 51*b*, and a bearing sleeve 50, having a fitting hole 50*a* to which the shaft body at input side 6 is rotatably fitted, is threadedly engaged to the threaded hole 51*b*. Since the other constructions and functions are the same as those described in Embodiments 2, 5 and 6, those same parts are indicated by the same reference numerals, and the description thereof is omitted.

The bearing sleeve 50 is designed so as to have a diameter larger than the flange 63 of the shaft body 6 by using a material having a smaller frictional resistance, and a screw 50*b* and a square portion 50*c* are provided on the circumferential surface thereof, with the screw 50*b* being threadedly engaged to the threaded hole 51*b*.

With respect to the shaft body 6, the power connecting portion 7 is inserted into the fitting hole 50*a* through one end of the bearing sleeve 50 so as to stick out from the other end, and the flange 63 prevents it from being drawn out from the other end.

In Embodiment 9, by fitting a tool such as a spanner to the square portion 50*c* of the bearing sleeve 50 with the shaft body 6 being fitted to the fitting hole 50*a*, the bearing sleeve 50 is easily attached to the threaded hole 51*b*, and by attaching this bearing sleeve 50, it is possible to prevent the shaft body 6 being drawn outside. Moreover, by loosening and removing the bearing sleeve 50, the shaft body 6 is readily removed together with the bearing sleeve 50.

Moreover, in the same manner as Embodiment 1, a portable mechanical-driving equipment B is coupled to the power connecting portion 7 of the shaft body 6, and even if a bending load is imposed on the shaft body 6 while the power of the portable mechanical-driving equipment B is being transmitted to the shaft body 6, the bending load is released from the shaft body 6 and applied onto the bearing sleeve 50 that is a member separated from the cover body 5; therefore, as compared with a case without the installation of the bearing sleeve 50, it becomes possible to make the rotation resistance of the shaft body 6 smaller, and consequently to reduce power losses of the portable mechanical-driving equipment B.

Here, in Embodiment 9, the shaft body 6 has a construction having the flange 63 in the same manner as Embodiments 2, 4, 5 and 6, and in addition to this, the shaft body 6 without the flange 63 as shown in Embodiments 1 and 3 may be adopted. In this case, the shaft body 6 can be fitted to the fitting hole 50*a* with the bearing sleeve 50 being attached to the cover body 5, and the shaft body 6 can be drawn from the fitting hole 50*a* without the need for removing the bearing sleeve 50 outside.

Embodiment 10

Figure 26:
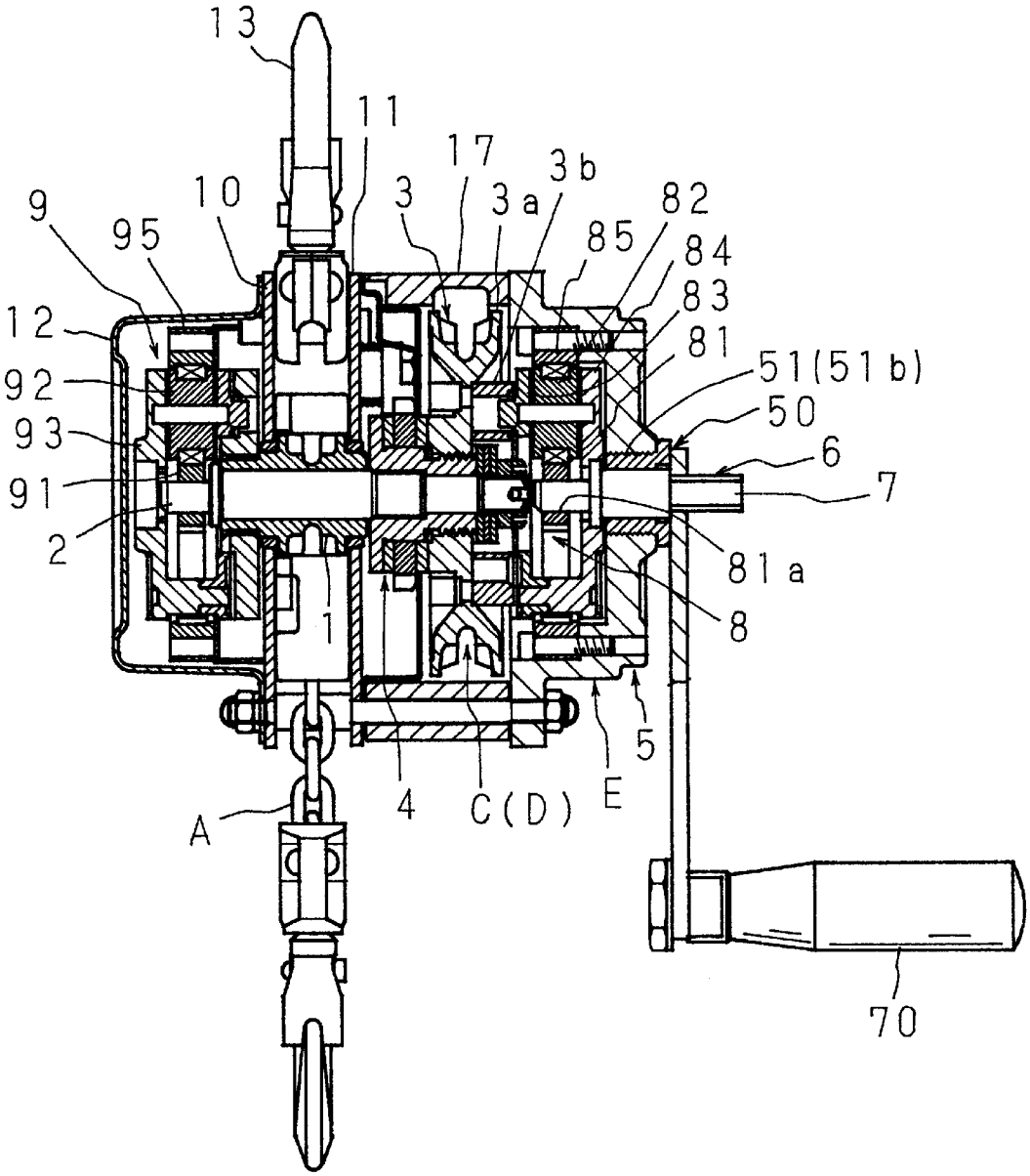
FIG. 26 is a cross-sectional view that shows a lifting gear of Embodiment 10 in accordance with the present invention.

FIG. 26 shows a cross-sectional view of a lifting gear. This lifting gear of Embodiment 10 has a modified construction of Embodiment 9 in which a handle 70 is detachably attached to the power connecting portion 7 of the shaft body 6. Since the other constructions and functions are the same as those described in Embodiments 1 and 9, those same parts are indicated by the same reference numerals, and the description thereof is omitted.

In Embodiment 10, in the case when the power of a portable mechanical-driving equipment B, such as a charging-type electric driver commercially available, is being transmitted to the shaft body 6, even if the battery runs short, or even if the portable mechanical-driving equipment B becomes out of order, the portable mechanical-driving equipment B is removed and the handle 70 is attached to the power connecting portion 7 of the shaft body 6. Thus, the load-sheave 1 is manually driven-by rotating the handle 70 so as to continue the lifting operation.

Embodiment 11

Figure 27:
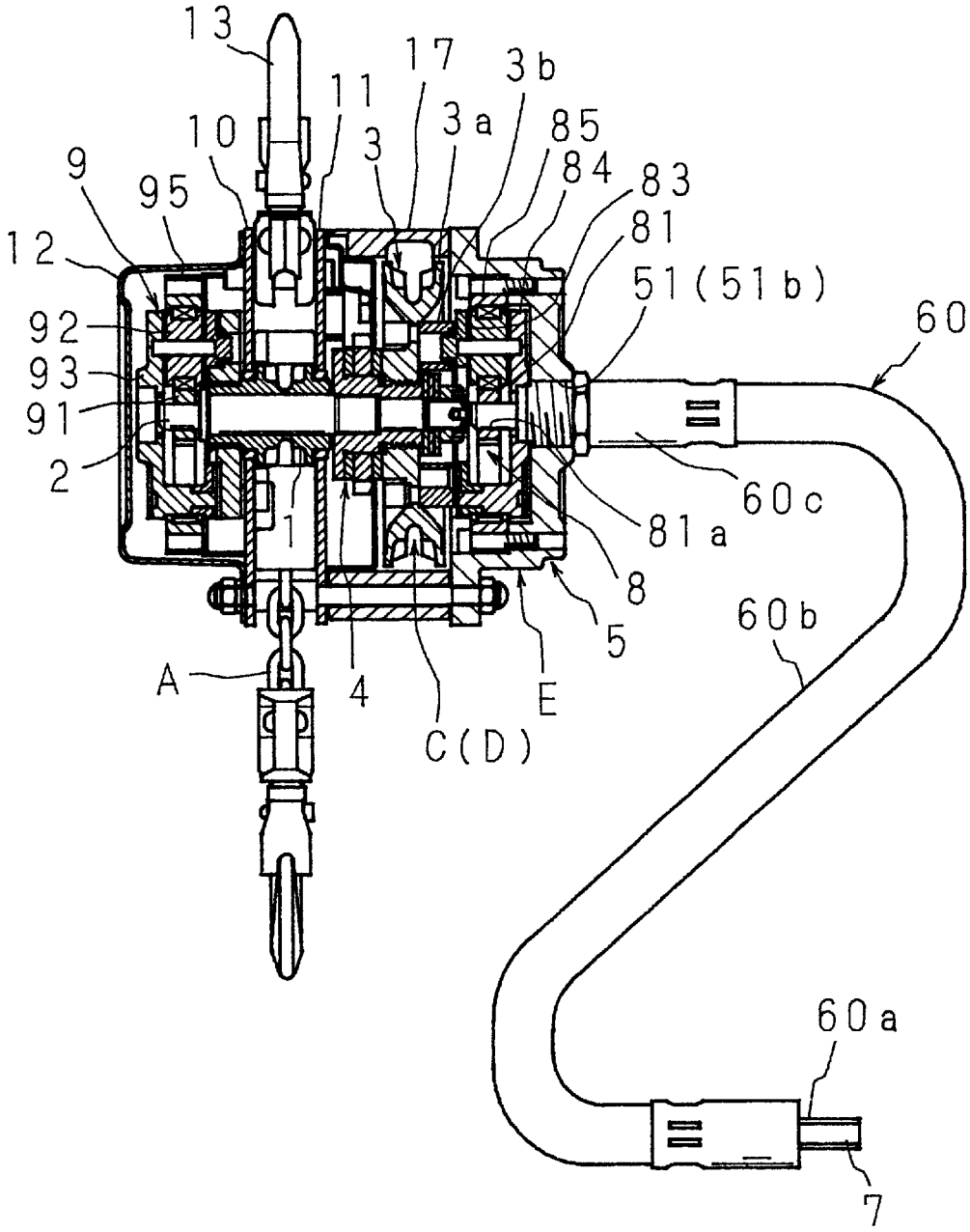
FIG. 27 is a cross-sectional view that shows a lifting gear of Embodiment 11 in accordance with the present invention.
Figure 28:
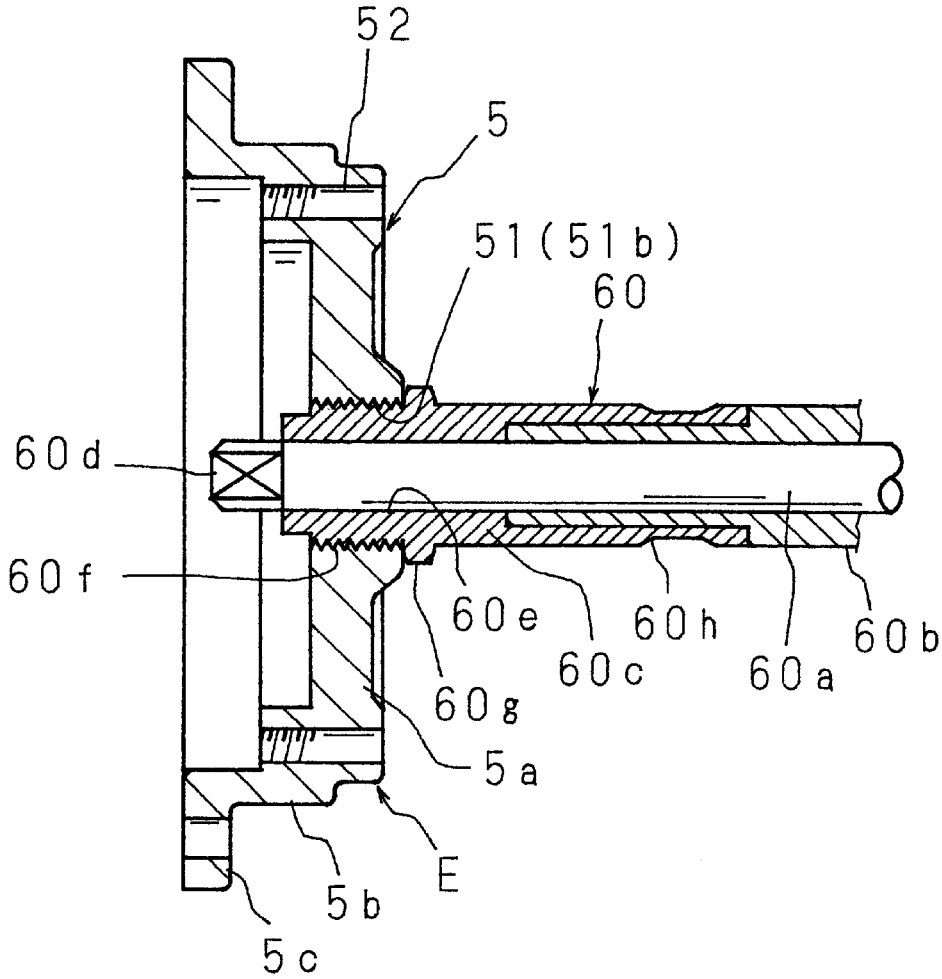
FIG. 28 is an enlarged cross-sectional view that shows a cover body and a shaft body of the lifting gear in accordance with the present invention.
Figure 29:
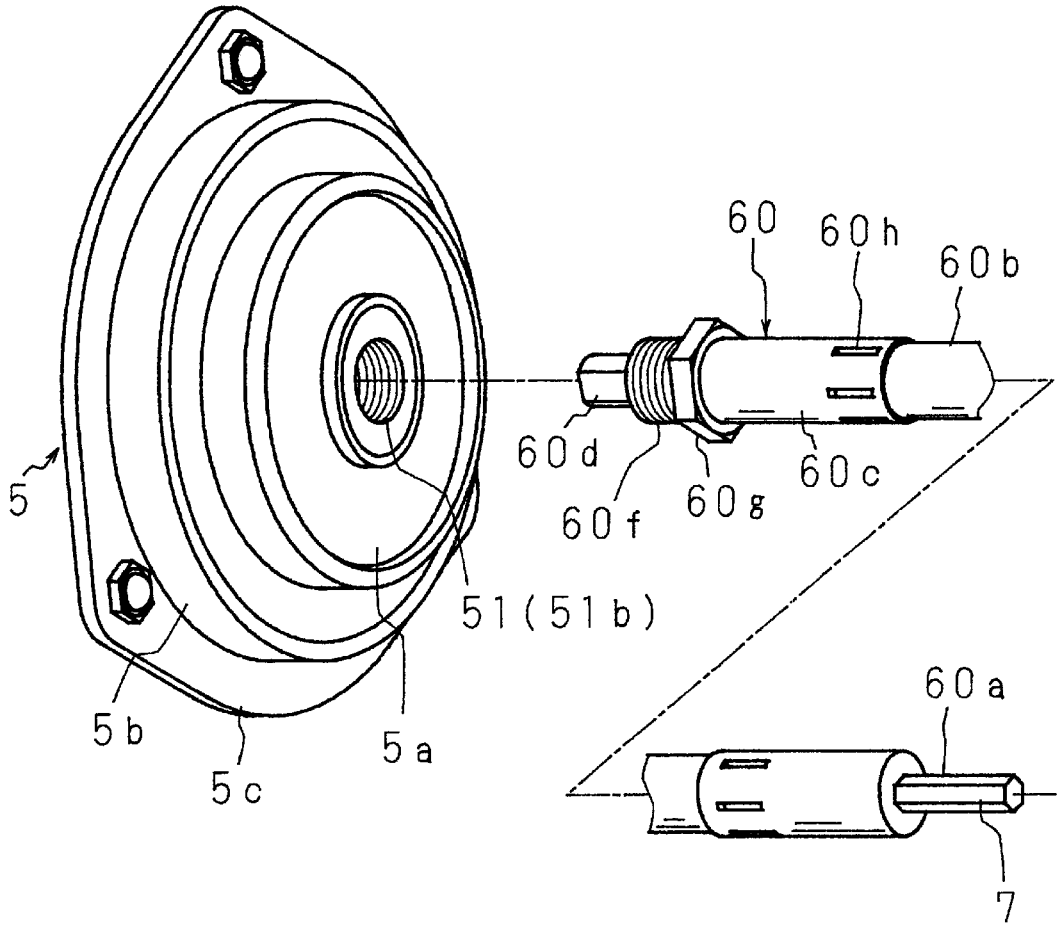
FIG. 29 is a perspective exploded view that shows the cover body and the shaft body of the lifting gear in accordance with the present invention.

FIG. 27 is a cross-sectional view of a lifting gear, FIG. 28 is an enlarged cross-sectional view of the cover body 5 and the shaft body 6, and FIG. 29 is a perspective exploded view of the cover body 5 and the shaft body 6. In the lifting gear of Embodiment 11, the hole 51 of Embodiments 1 through 6 is provided as a threaded hole 51*b*, and instead of the shaft body 6, a shaft body 60 is provided. The shaft body 60 is provided with: a flexible shaft 60*a* which has a link portion 60*d* at one end that is allowed to connect the input gear 81 by the connecting to the fitting hole 81*a* and has the power connecting portion 7 at the other end; a flexible tube 60*b* for rotatably housing the flexible shaft 60*a*; and a bearing sleeve 60*c* which is connected to one end of the-flexible tube 60*b* by caulking and has a fitting hole 60*e* to which the flexible shaft 60*a* is fitted. Since the other constructions and functions are the same as those described in Embodiments 1 through 6, those same parts are indicated by the same reference numerals, and the description thereof is omitted.

The bearing sleeve 60*c* is formed by a material having a small frictional resistance, and provided with a screw 60*f*, a square portion 60*g* and a caulked portion 60*h* on its outer circumferential surface, with the screw 60*f* being threadedly engaged to the threaded hole 51*b*.

In Embodiment 11, a tool such as a spanner is fitted to the square portion 60*g* of the bearing sleeve 60*c* so that the bearing sleeve 60*c* is threadedly engaged to the threaded hole 51*b* so as to attach the shaft body 60 to the cover body 5. Moreover, by loosening the bearing sleeve 60*c*, the shaft body 60 can be removed.

Moreover, in the case when a portable mechanical-driving equipment B is coupled to the power connecting section 7 of the shaft body 60 with the power of the portable mechanical-driving equipment B being transmitted to the shaft body 60, even if a bending load is imposed on the attaching portion of the shaft body 60 to the cover body 5, the bending load, which is imposed on the flexible shaft 60*a*, can be applied to the bearing sleeve 60*c*; therefore, as compared with a case without the installation of the bearing sleeve 60*c*, it is possible to reduce the rotation resistance of the flexible shaft 60*a*, and consequently to reduce power losses of the portable mechanical-driving equipment B.

Embodiment 12

Figure 30:
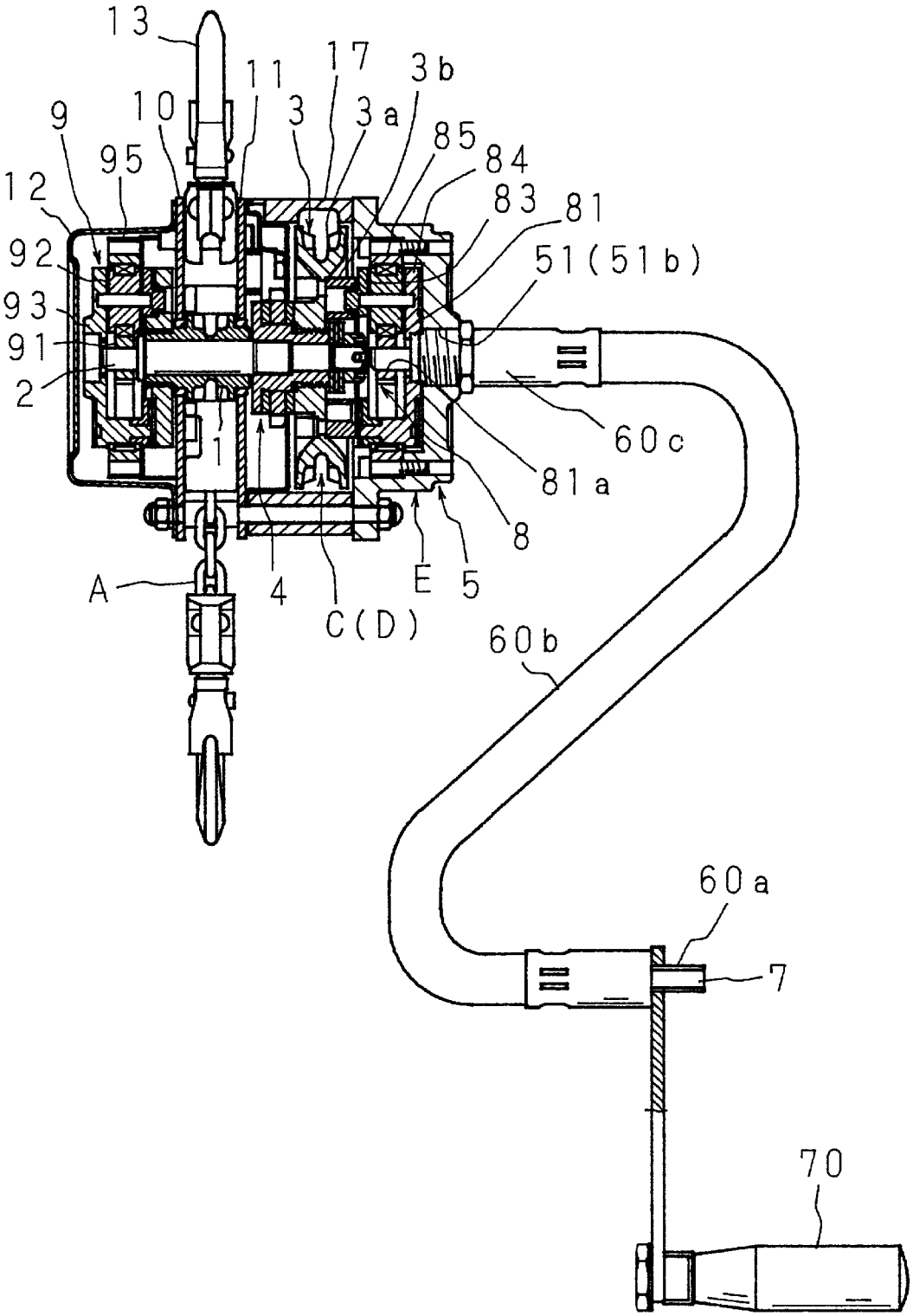
FIG. 30 is a cross-sectional view that shows a lifting gear of Embodiment 12 in accordance with the present invention.

FIG. 30 is a cross-sectional view of a lifting gear. The lifting gear of Embodiment 12 is provided with a handle 70 that is detachable attached to the power connecting section 7 of the flexible shaft 60*a* of Embodiment 11. Since the other constructions and functions are the same as those described in Embodiments 1 and 11, those same parts are indicated by the same reference numerals, and the description thereof is omitted.

In Embodiment 12, in the case when the power of a portable mechanical-driving equipment B, such as a charging-type electric driver commercially available, is being transmitted to the shaft body 60, even if the battery runs short, or even if the portable mechanical-driving equipment B becomes out of order, the portable mechanical-driving equipment B is removed and the handle 70 is attached to the power connecting portion 7 of the flexible shaft 60*a*. Thus, the load-sheave 1 is manually driven by rotating the handle 70 so as to continue the lifting operation.

Here, in Embodiments 9 through 12, instead of the arrangement in which the hole 51 is provided as the threaded hole 51*b* and the bearing sleeve 50, 60*c* is threadedly engaged to the threaded hole 51*b*, the hole 51 may be provided as a fitting hole and the bearing sleeve 50, 60*c* may be pressure-inserted into the fitting hole. Moreover, a flange is installed on the bearing sleeve 50, 60*c* and the flange may be attached to the cover body 5 by means of a securing means such as tightening screws; thus, the securing means of the bearing sleeve 50 is not particularly limited.

Furthermore, the bearing sleeve 50, 60*c* may have a structure integrally formed of a metal material, etc. or a structure in which a bearing such as a needle bearing, and a ball bearing is held on the inner surface thereof.

In Embodiments 1 through 12, the load-sheave 1 may have a structure in which a sinuate body using a load chain is shifted in the longitudinal direction, or a structure in which a sinuate body using a roller chain is shifted in the longitudinal direction, or a structure in which a sinuate body using a belt is shifted in the longitudinal direction; thus, the structure of the load-sheave 1 is not particularly limited.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A lifting gear, comprising:

a load-sheave for shifting a sinuate body in a longitudinal direction thereof; and a rotary body for rotating the load-sheave and extending along a central axis of the load-sheave and driven by a portable drive, wherein the rotary body includes a stick-like power connecting portion that is coaxial with the central axis of the load-sheave and is coupled to the portable drive, a frame for covering the load-sheave and the rotary body, the frame including a hole through which the power connecting portion extends, and, wherein the rotary body is divided into a shaft body inserted into the hole and an interlock body interlocked and movable with the load-sheave.

2. The lifting gear according to claim 1, wherein the shaft body is removable from the hole.

3. The lifting gear according to claim 2, wherein the shaft body is fitted into the hole.

4. The lifting gear according to claim 2, comprising a bearing sleeve having a bearing sleeve hole in which the shaft body is received and which matches a shape of the shaft body, the bearing sleeve being attached to the frame and disposed in the hole.

5. The lifting gear according to claim 4, wherein the hole is a threaded hole, and the bearing sleeve has an external screw thread that engages the threaded hole.

6. The lifting gear according to claim 2, further comprising a handle that is detachably attached to the power connecting portion.

7. The lifting gear according to claim 1, wherein the shaft body is fitted into the hole.

8. The lifting gear according to claim 1, comprising a bearing sleeve having a bearing sleeve hole in which the shaft body is received and which matches a shape of the shaft body, the bearing sleeve being attached to the frame and disposed in the hole.

9. The lifting gear according to claim 8, wherein the hole is a threaded hole, and the bearing sleeve has an external screw thread that engages the threaded hole.

10. The lifting gear according to claim 1, further comprising a handle that is detachably attached to the power connecting portion.

11. A lifting gear, comprising:

a load-sheave for shifting a sinuate body in a longitudinal direction thereof; and a rotary body for rotating the load-sheave and extending along a central axis of the load-sheave and driven by a drive;

a frame for covering the load-sheave and the rotary body, the frame including a hole through which the power connecting portion extends, wherein the rotary body includes a power connecting portion that is coaxial with the central axis of the load-sheave and is coupled to the drive, wherein the rotary body is divided into a shaft body inserted into the hole and an interlock body interlocked and movable with the load-sheave, and wherein the shaft body includes, at a first end thereof, a link portion which is connected to the interlock body, and the shaft body also includes, at a second end thereof, a flexible shaft having the power connecting portion, a flexible tube that rotatably houses the flexible shaft, and a bearing sleeve that is connected to one end of the flexible tube and has a bearing sleeve hole having a shape that matches a shape of the flexible shaft and in which the flexible shaft is fitted.

12. A lifting gear, comprising:

a load-sheave for shifting a sinuate body in a longitudinal direction thereof; and a rotary body for rotating the load-sheave and extending along a central axis of the load-sheave and driven by a drive;

a frame for covering the load-sheave and the rotary body, the frame including a hole through which the power connecting portion extends, wherein the rotary body includes a power connecting portion that is coaxial with the central axis of the load-sheave and is coupled to the drive, wherein the rotary body is divided into a shaft body inserted into the hole and an interlock body interlocked and movable with the load-sheave, wherein the shaft body is removable from the hole, and wherein the shaft body includes, at a first end thereof, a link portion which is connected to the interlock body, and the shaft body also includes, at a second end thereof, a flexible shaft having the power connecting portion, a flexible tube that rotatably houses the flexible shaft, and a bearing sleeve that is connected to one end of the flexible tube and has a bearing sleeve hole having a shape that matches a shape of the flexible shaft and in which the flexible shaft is fitted.

13. A lifting gear, comprising:

a load-sheave for shifting a sinuate body in a longitudinal direction thereof; and a rotary body for rotating the load-sheave and driven by a drive, wherein the rotary body includes a power connecting portion coupled to the drive, a frame for covering the load-sheave and the rotary body, the frame including a hole through which the power connecting portion extends, the rotary body includes the power connecting portion, and is divided into a shaft body inserted into the hole and an interlock body interlocked and movable with the load-sheave, wherein the interlock body includes an interlock body shaft body facing the shaft body along a length direction of the shaft body, a ring body that is threadedly engaged to the interlock body shaft body so as to rotate forwardly and reversely with the interlock body shaft body, and a braking mechanism that transmits forward rotation of the ring body to the interlock body shaft body and applies a braking force to reverse rotation of the interlock body shaft body; and wherein a reduction mechanism is installed between the ring body and the shaft body.

14. The lifting gear according to claim 13, wherein the reduction mechanism includes an input gear to which a rotation force of the interlock body shaft body is input, a planetary gear that revolves around the input gear so as to transmit its revolution force to the ring body, and a ring-shaped gear that supports the planetary gear inside the frame.

15. The lifting gear according to claim 14, further comprising a chain latch portion an outer circumference of the ring body and a chain latched on the outer circumference of the ring body by the chain latch portion.

16. The lifting gear according to claim 13, further comprising a chain latch portion provided at an outer circumference of the ring body and a chain latched on the outer circumference of the ring body by the chain latch portion.

17. A lifting gear, comprising:

a load-sheave for shifting a sinuate body in a longitudinal direction thereof;

a shaft body that rotatably penetrates the load-sheave;

a ring body that is threadedly engaged to one end of the shaft body so as to rotate forwardly or reversely in an interlocked manner with the shaft body when driven by a driving means;

a braking mechanism that transmits forward rotation of the ring body to the shaft body and applies a braking force to reverse rotation of the shaft body, the braking mechanism being installed on one end of the shaft body;

a cover body for covering the ring body, the cover body being installed on one end of the shaft body;

a reduction gear mechanism installed between a second end of the shaft body and the load-sheave;

a power connecting portion coupled to the driving means, the power connecting portion being disposed inside the cover body;

a second shaft body that faces the shaft body along a length direction of the shaft body, the second shaft body being installed inside the cover body; and a planetary reduction mechanism which includes an input gear to which rotation force of the second shaft body is inputted, a planetary gear that revolves around the input gear so as to transmit its revolution force to the ring body and a ring-shaped sun gear that engages the planetary gear, the planetary reduction mechanism being installed inside the cover body.

18. The lifting gear according to claim 17, wherein a bearing sleeve having a hole matching a shape of the second shaft body and in which the shaft body is fitted is attached to the cover body, the power connecting portion being placed outside the bearing sleeve.

* * * * *